US005984213A

United States Patent [19]

Woodall et al.

[11] Patent Number: 5,984,213

[45] **Date of Patent: *Nov. 16, 1999**

[54] ATTRITION MILL

[75] Inventors: Peter Woodall, Mt Isa, Australia; Udo Enderle, Marktredwitz, Germany

[73] Assignees: Mount Isa MInes Limited, Queenlands, Australia; Erich Netzsch GmgH & Co. Holding KG, Selb, Germany

[ * ] Notice: This patent is subject to a terminal disclaimer.

[21] Appl. No.: 09/107,366

[22] Filed: Jun. 30, 1998

Related U.S. Application Data

[63] Continuation-in-part of application No. 08/727,433, Oct. 11, 1996, Pat. No. 5,797,550.

[30] Foreign Application Priority Data

| | | | |
|---|---|---|---|
| Apr. 11, 1994 | [DE] | Germany | 44 124 08 |
| Jun. 22, 1994 | [AU] | Australia | PM 6394 |
| Dec. 20, 1994 | [AU] | Australia | PN 0166 |

[51] Int. Cl.[6] ..... B02C 17/14

[52] U.S. Cl. ..... 241/21; 241/171; 241/172

[58] Field of Search ..... 241/21, 171, 172, 241/79, 79.1, 20

[56] References Cited

U.S. PATENT DOCUMENTS

| | | | |
|---|---|---|---|
| 4,784,336 | 11/1988 | Lu | 241/171 |
| 5,312,051 | 5/1994 | Preisser . | |
| 5,333,804 | 8/1994 | Liebert | 241/172 X |
| 5,566,896 | 10/1996 | Stehr et al. | 241/171 |
| 5,597,126 | 1/1997 | Frommherz et al. | 241/172 |
| 5,620,147 | 4/1997 | Newton | 241/171 |
| 5,630,557 | 5/1997 | Barnthemess | 241/171 |

FOREIGN PATENT DOCUMENTS

| | | | |
|---|---|---|---|
| 41496/89 | 9/1989 | Australia . | |
| 0403694 | 12/1990 | European Pat. Off. . | |
| 2437873 | 4/1980 | France . | |
| 3726610 | 7/1988 | Germany . | |
| 3844380 | 1/1990 | Germany | 241/171 |
| 1579288 | 11/1980 | United Kingdom . | |
| 2120126 | 11/1983 | United Kingdom . | |
| 2268425 | 1/1994 | United Kingdom . | |

OTHER PUBLICATIONS

Derwent Abstract, Accession No. 94–133115/16 SU1793962 A3 (Teckknoint Stock Co) Feb. 7, 1993.

*Primary Examiner*—Mark Rosenbaum
*Attorney, Agent, or Firm*—Steven, Davis, Miller & Mosher, L.L.P.

[57] ABSTRACT

An attrition mill comprising a grinding chamber (1), an axial impeller (10), a chamber inlet (3) for admitting coarse particles and a separator comprising a chamber outlet (6) through which fine particles exit from the chamber. The mill is characterized in that a classification as between coarse and the fine particles is performed in the mill upstream of the separator.

36 Claims, 26 Drawing Sheets

ATTRITION MILL

The present application is a continuation-in-part of U.S. patent application Ser. No. 08/727,433, filed Oct. 11, 1996, now patented as U.S. Pat. No. 5,797,550, incorporated herein by reference in its entirety.

FIELD OF THE INVENTION

The present invention relates to an attrition mill and a method of, and apparatus for, classifying fine particles in a slurry of coarse and fine particles. More particularly, the invention relates to a classification system and a separation system for an attrition mill which permits outlet of ground mineral fines and a small quantity of spent grinding media from the mill while retaining useful grinding media in the mill for further attrition.

BACKGROUND OF THE INVENTION

Hitherto, attrition mills have been mainly used for high value low throughput applications (e.g. below about 10 cubic meters per hour). The present invention was developed for use in mineral beneficiation in the mining industry which requires higher throughput volume than other industries in which attrition mills have previously been used.

Although the invention is herein described with particular reference to its use in a mill, it is not limited to that use and may have more general application in particle separation.

The term "attrition mill" is herein used to include mills used for ultra-fine grinding for example, stirred mills in any configuration such as bead mills, peg mills; wet mills such as ball mills, colloid mills, fluid energy mills, ultrasonic mills, petite pulverisers, and the like grinders. In general, such mills comprise a grinding chamber and an axial impeller having a series of mainly radially directed grinding elements such as arms or discs, the impeller being rotated by a motor via a suitable drive train. The grinding elements are approximately equally spaced along the impeller by a distance chosen to permit adequate circulation between the opposed faces of adjacent grinding elements and having regard to overall design and capacity of the mill, impeller speed and diameter, grinding element design, mill throughput and other factors.

Such mills are usually provided with grinding media and the source material to be ground is fed to the mill as a slurry. Although the invention is herein described with particular reference to the use of exogenous grinding media, it will be understood that the invention may be applied to mills when used for autogenous or semi-autogenous grinding. In the case for example of a stirred mill used for grinding pyrite, arseno-pyrite, or the like, the grinding medium may be spheres, cylinders, polygonal or irregularly shaped grinding elements or may be steel, zircon, silica-sand, slag, or the like. In the case of a bead mill used to grind a sulphide ore (for example galena, pyrite) distributed in a host gangue (for example, shale and/or silica) the gangue may itself be sieved to a suitable size range, for example 1–6 millimeters or 1–4 millimeters, and may be used as a grinding medium. The media size range is dependant on how fine the grinding is required to be. From about 40% to about 95% of the volume capacity of the mill may be occupied by grinding media.

It should be recognized that in the grinding process, grinding media undergoes size reduction as does source material to be ground. Grinding media which is itself ground to a size no longer useful to grind source material is referred to as "spent" grinding media. Grinding media still of sufficient size to grind source material is referred to as "useful" grinding media.

A source material to be ground, for example a primary ore, mineral, concentrate, calcine, reclaimed tailing, or the like, after preliminary size reduction by conventional means (for example to 20–90 microns), is slurried in water and then admitted to the attrition mill through an inlet in the grinding chamber. In the mill, the impeller causes the particles of grinding media to impact with source material, and particles of source material to impact with each other, fracturing the source material to yield fines (for example 0.5–25 microns). It is desirable to separate the coarse material from the fines at the mill outlet so as to retain useful grinding media and unground source material in the mill while permitting the fines and spent grinding media to exit the mill.

In existing attrition mills, outlet separation is achieved by means of a perforated or slotted screen at, or adjacent to, the mill exit and having apertures dimensioned to allow passage of spent grinding media and product but not permitting passage of useful grinding media. For example, if it is desired to retain particles of greater than 1 mm in the mill, the outlet screen aperture width would be a maximum of 1 mm so that only particles smaller than 1 mm would exit the mill through the screen. The outlet may in addition comprise a scraper or a separator rotor to reduce screen clogging. The axial spacing between the facing surfaces of the separator rotor and the last downstream grinding element is approximately equal to the spacing between the facing surfaces of all the other pairs of grinding elements.

The design and operation of attrition mills and media selection is highly empirical. Although various mathematical computer-based models have been proposed, none have yielded satisfactory predictions of mill performance.

In attempting to finely grind a sulphide ore using various grinding media in a high throughput bead mill e.g. having a mill throughput of greater than 10 TPH, it was found that the outlet screen rapidly clogged reducing the throughput to an intolerably low level. Moreover, the rate of wear of the separator rotor and outlet screen rendered operation uneconomic.

DISCLOSURE OF THE INVENTION

It is an object of the present invention to provide improved means for classification and/or separation of coarse particles from fine particles in a slurry. It is an object of preferred embodiments of the invention to provide an improved outlet for an attrition mill which reduces or eliminates screen plugging and reduces wear in the separator stage to acceptable levels.

According to a first aspect, the invention consists in an attrition mill comprising a grinding chamber; an axial impeller; a chamber inlet for admitting coarse particles; and a separator comprising a chamber outlet through which fine particles exit from the chamber, said mill being characterised in that a classification as between coarse and fine particles is performed in the mill upstream of the separator.

In a highly preferred embodiment the chamber outlet includes one or more orifices having openings of large dimension in comparison with the fine is particles. Alternatively, the chamber outlet may include a screened outlet similarly having comparatively large openings. Additionally, the separator may include a separator rotor.

In preferred embodiments of the invention the maximum size of particles exiting from the mill is substantially independent of the minimum orifice dimensions of the chamber outlet.

The minimum chamber outlet orifice dimension may be at least twice the average maximum dimension of spent grinding media which exits from the chamber and in preferred embodiments is at least ten times (and more preferably greater than 20 times) the average maximum dimension of spent media which exits. In apparatus according to the invention a classification between fine and coarse particles is performed by classification means upstream of the separator, preferably on the basis of particle mass. The orifice dimensions of the chamber outlet are determined by the need to control other factors (for example back pressure) and not by the size of particles exiting at the outlet.

According to a second aspect the invention consists in an attrition mill according to the first aspect further including at least two grinding elements spaced apart by a distance "g" along the axial impeller and a classification element upstream from the separator spaced along the impeller from an adjacent grinding element by a distance "c", wherein "c" is less than "g".

Preferably "c" is less than 0.75 g. Desirably, "c" is less than 0.6×"g" and greater than 0.01×"g". More desirably, "c" is less than 0.6×"g" and greater than 0.4×"g".

Preferably also, "g" is selected to optimize grinding and "c" is selected so as to classify the fine particles from a mixture of the coarse and fine particles.

Expressed another way, "g" is preferably selected to permit the coarse and fine particles to circulate radially between the periphery of the grinding elements and the impeller shaft.

According to a third aspect the invention consists in apparatus for classifying particles in a slurry comprising:

a classifier element defining a first surface driven in rotation about an axis, a second surface spaced from and facing the first surface so as to define a passage therebetween, a classifier inlet for admitting slurry to the passage, a first classifier outlet spaced from the classifier inlet whereby the slurry exits from the passage, a second classifier outlet spaced radially outwardly of the classifier inlet, means for causing the slurry to flow from the classifier inlet to the first classifier outlet at a predetermined volumetric flow rate, and wherein the first surface is spaced sufficiently closely to the second and is rotated at sufficient speed so that a majority of the particles in the passage having a mass of less than a predetermined mass remain entrained with slurry flowing to the first classifier outlets and a majority of the particles exceeding the predetermined mass are disentrained and move outwardly from the passage at the second classifier outlet.

In highly preferred embodiments according to the invention the passage is defined between two members which may be rotated (or counter rotated) independently of the axial impeller and/or of each other.

In a particularly preferred embodiment, the classifier inlet is in one member and the first classifier outlet is in the second member.

In another particularly preferred embodiment, the classifier inlet passes through the first surface and the first classifier outlet passes through the second surface. In this embodiment the second classifier outlet is the external boundary of the passage.

In another preferred embodiment, the invention also includes a separator stage comprising a separator rotor mounted to the impeller and spaced axially from an end plate to define a radially extending separation passage therebetween, said first classifier outlet admits slurry to the separation passage at a radially inner region of the separator element, baffle means at or near the separation passage periphery to permit passage of coarse particles travelling outwardly to beyond the separation passage periphery, and a slurry outlet spaced axially from the radially extending separation passage to permit passage of the fine particles out of the mill.

Desirably, the baffle means are in the form of axial fingers positioned around the periphery of the separator rotor and extending towards the chamber outlet.

According to a fourth aspect of the invention there is provided an attrition mill comprising:

a separator outlet;

an impeller including grinding elements;

a grinding chamber at least partially filled with a slurry including grinding media which passes generally axially through the chamber;

a separator element having one or more axial holes therethrough upstream of, and adjacent to, a separator outlet said separator element mainly directing the grinding media radially outwardly from the impeller;

wherein the separator element surrounds the separator outlet such that at least some of the slurry flows towards the separator outlet and passes through the axial holes in the separator element.

BRIEF DESCRIPTION OF THE DRAWINGS

The invention will now be more particularly described by way of example only with reference to the accompanying drawings in which.

PREFERRED EMBODIMENTS OF THE INVENTION

Figure 1:
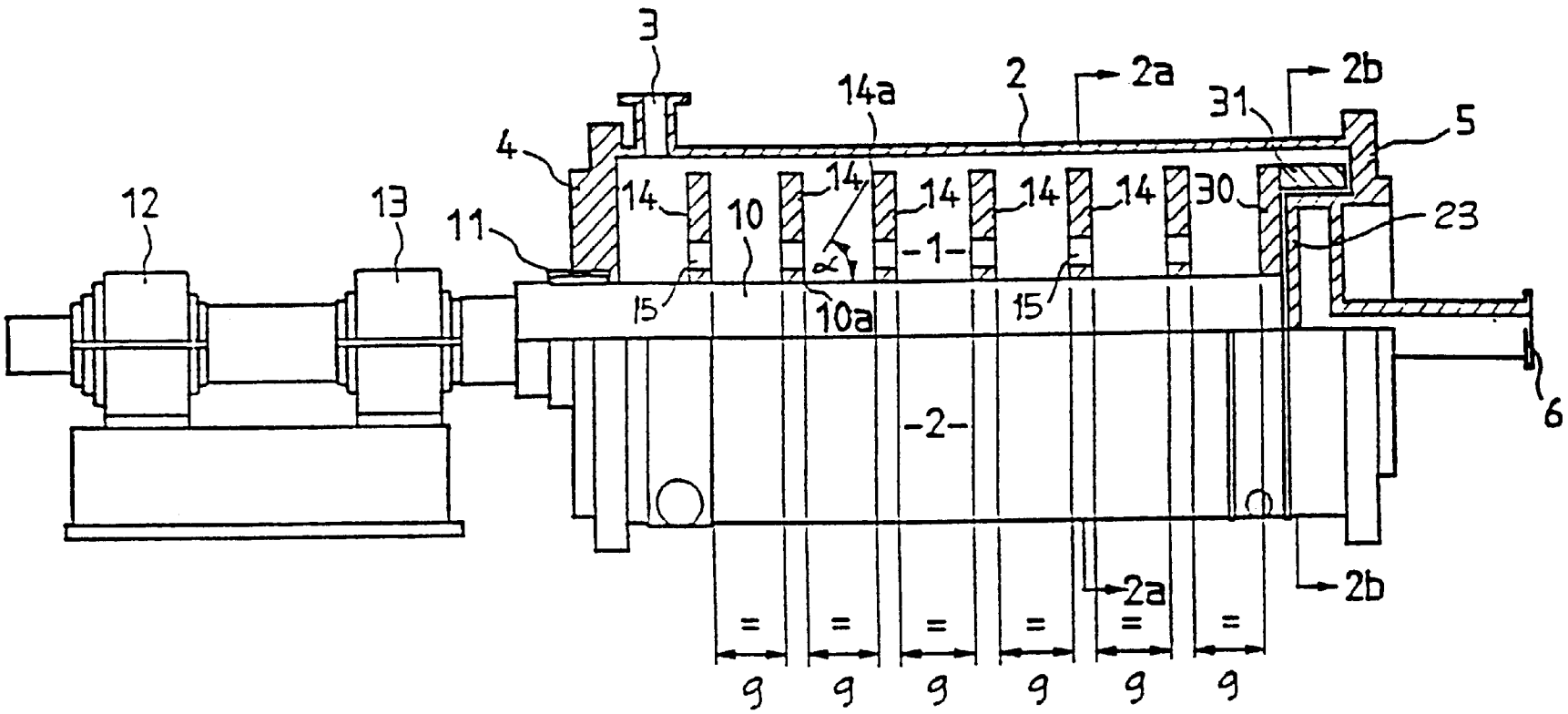
FIG. 1 (PRIOR ART)
FIG. 1 is a schematic drawing, partly sectioned, showing a prior art attrition mill in side elevation.
Figure 2A:
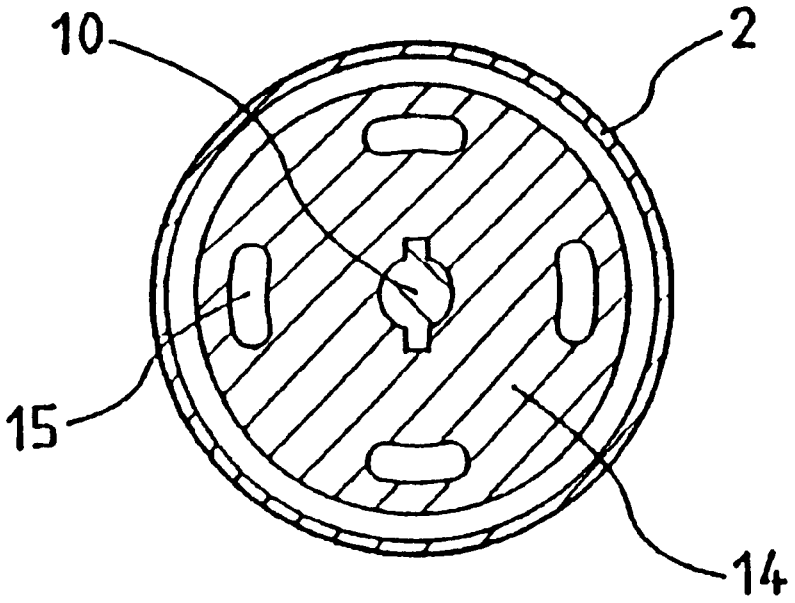
FIG.2a (PRIOR ART)
FIG. 2*a* and FIG. 2*b* show cross sections through the mill of FIG. 1 on line 2*a*—2*a* and 2*b*—2*b*.
Figure 2B:
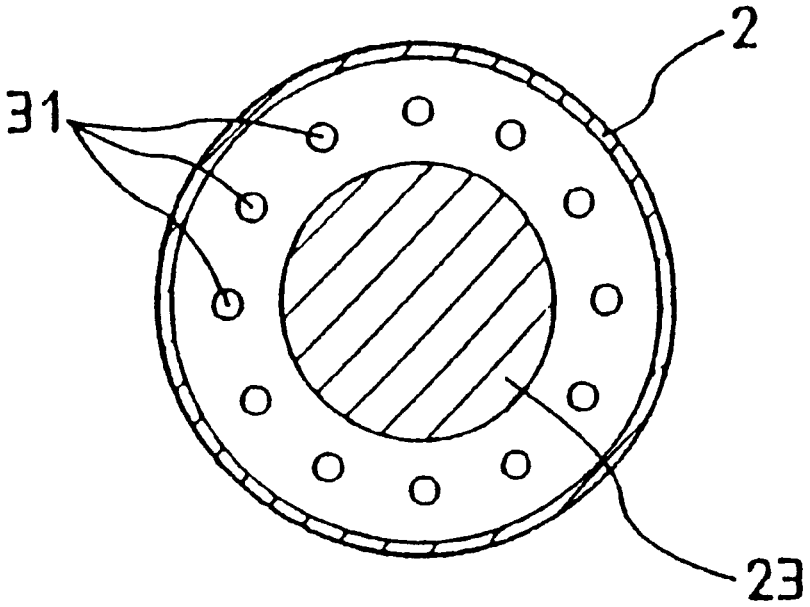
FIG.2b (PRIOR ART)

With reference to FIG. 1 there is shown schematically a prior art attrition mill comprising a grinding chamber 1 defined by a generally cylindrical side wall 2, an inlet end wall 4 and a discharge end wall 5. Chamber 1 is provided with an inlet port 3 and an outlet pipe 6. Chamber 1 is mounted to foundations by means not illustrated. An axial impeller shaft 10 extends through inlet end wall 4 at a sealing device 11. Shaft 10 is driven by a drive train (not illustrated) and is supported by bearings 12 and 13. Internally of chamber 1, impeller shaft 10 is fitted with a series of radially directed grinding discs 14 each of which when viewed in plan is seen to be pierced by equiangularly-spaced openings 15 (shown in FIG. 2*a*). In the present example grinding discs 14 are keyed to shaft 10 and are spaced by a distance "g" from adjacent grinding discs 14.

Figure 3:
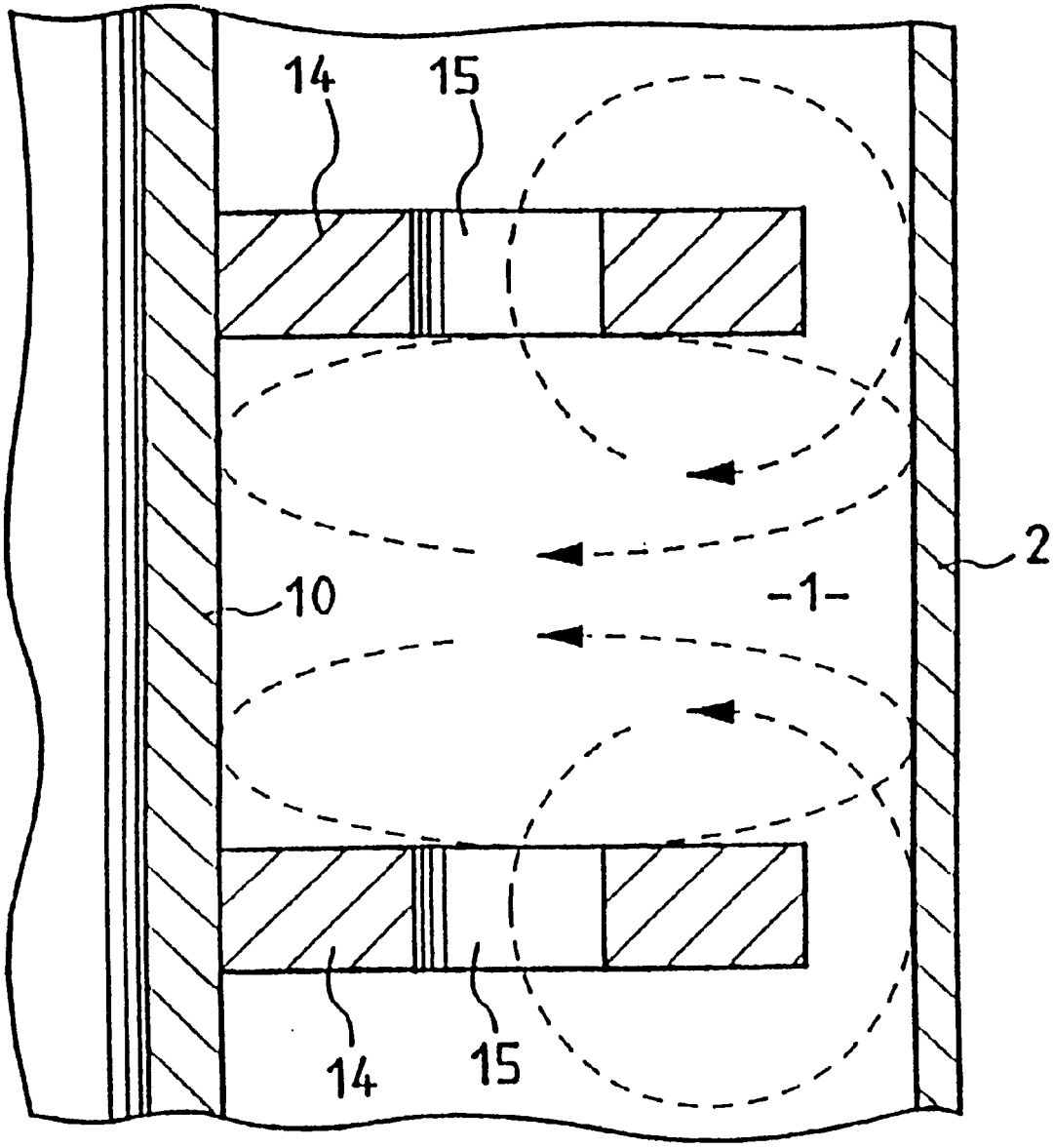
FIG.3 (PRIOR ART)
FIG. 3 is a schematic drawing indicating some of the slurry flow paths between grinding discs of the mill of FIG. 1.

With reference to FIG. 3 there are shown schematical flow patterns (indicated by arrowed lines) believed to occur in and around adjacent grinding discs 14 of the mill of FIG. 1. Slurry circulates through apertures 15 in grinding discs 14 and particles also enter between facing surfaces of grinding discs 14 and are flung against other particles, against the shaft between grinding discs, against the disc surfaces, and against the mill walls. Slurry circulates in a radial direction between the discs and preferably to adjacent shaft 10.

Figure 4:
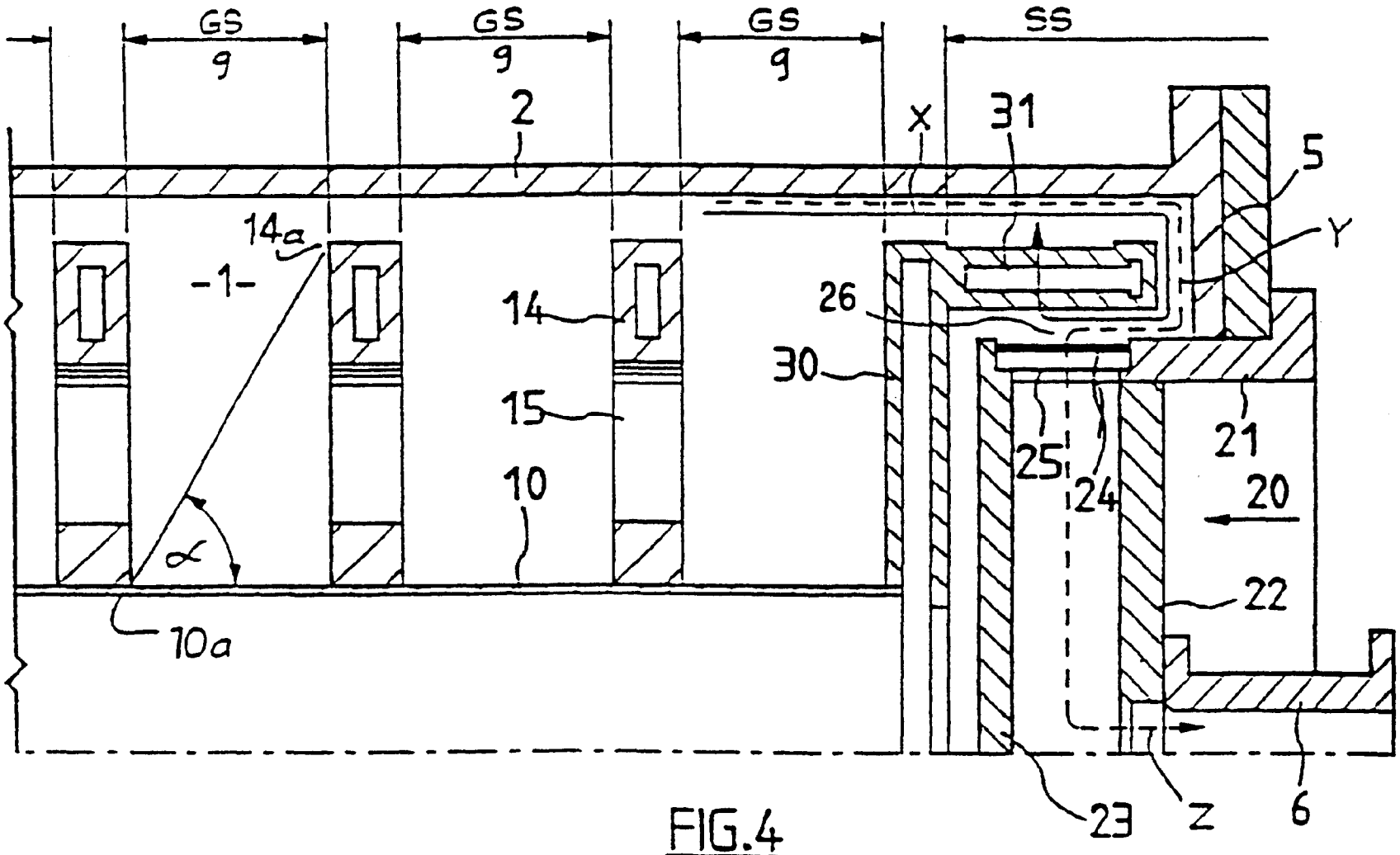
FIG. 4 (PRIOR ART)
FIG. 4 is an enlarged side elevation of a prior art separator assembly of the mill of FIG. 1.

The distance "g" between adjacent grinding discs 14 may alternatively be defined as a "separation" angle $\alpha$ between adjacent grinding discs. The separation angle $\alpha$ is the angle between the shaft and a line extending from the radially inner end of one grinding disc (at the shaft periphery boa) to the radially outer tip 14*a* of the neighbouring grinding disc (as indicated in FIGS. 1 and 4). If the grinding discs are too closely spaced (e.g. the separation angle exceeds 60°) then media does not circulate between discs 14 as shown and grinding efficiency is lost. A separation angle of between 30° and 60° is preferred for optimum grinding efficiency and minimum wear.

With reference to FIG. 4 a portion of a prior art separating stage of a mill similar to that of FIG. 1 is shown in enlarged detail.

Discharge endwall 5 is of annular shape and defines a circular opening into which is let a displacement body indicated generally at 20 and consisting of a cylindrical portion 21 and an outer plate 22. Cylindrical portion 21 seals with end wall 5 and with outlet pipe 6. Displacement body 20 further comprises a displacement body inner plate 23 spaced axially from outer plate 22 to define a generally cylindrical outlet opening 25 which is disposed circumferentially of displacement body inner plate 23 and extends between inner plate 23 and outer plate 22. Outlet opening 25 is covered by a cylindrical screen 24. Screen 24 has apertures of dimensions selected to allow the passage of sufficiently fine ground product out of the mill but to retain useful grinding media in the mill.

A separator rotor 30 is provided downstream of the last grinding disc 14 and at or adjacent the end of impeller shaft 10. Rotor 30 is spaced apart from displacement body inner plate 23 and is provided with a plurality of fingers 31 which extend parallel to the impeller axis and are equiangularly spaced at the periphery of rotor 30 and spaced radially outwardly of screen 24. The separator rotor 30 is also spaced from the last grinding disc by the distance "g".

In use of the prior art outlet stage, the slurry containing coarse and fine particles is known to travel adjacent to side wall 2 as indicated at (x) to end wall 5, the solid line in the drawings is representing the flow passage of coarse particles (e.g. useful grinding media) in the slurry and the broken line representing the movement of fine particles (e.g. ground product and spent media) in the slurry. The slurry travels radially inwardly at (y) adjacent to end wall 5 and then enters axially directed passage 26 defined between screen 24 and rotor fingers 31.

As discussed previously, outlet screen 24 is apertured so as to permit passage of fine particles which pass through screen 24 and outlet 25 and exit the mill at (z) via outlet pipe 6, while coarse particles are rejected by screen 24. Axial rotation of the slurry by separator rotor fingers 30 over the screen is intended to prevent the screen from clogging with coarse particles which are unable to pass through screen 24 and instead pass through fingers 31 and away from the screen. The grinding stages of the mill are denoted "GS" and the separation stage denoted "SS".

Figure 5:
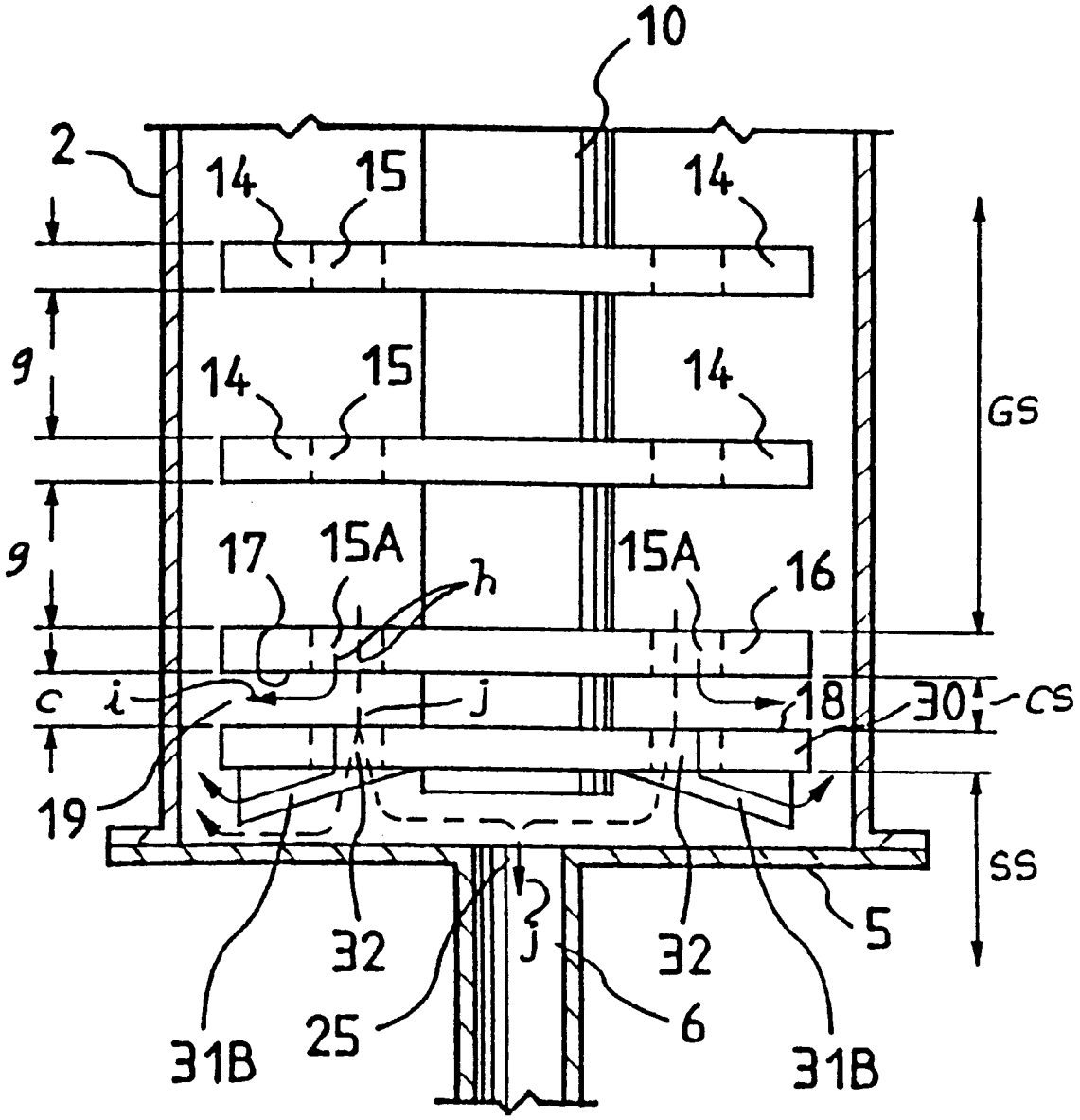
FIG. 5 is a schematic cross sectional elevation of a first embodiment of a classification stage according to the invention.

With reference to FIG. 5, there is shown a first embodiment of apparatus according to the invention wherein a classifier stage denoted "CS" is provided upstream of the separator stage "SS". In FIGS. 5 to 25 parts corresponding to those used in FIGS. 1 to 4 are identified with corresponding numerals and attention will be directed primarily to differences from the apparatus of FIGS. 1 to 4.

In a simple form of the invention, the separator system of FIG. 5 employs an outlet in the form of unscreened pipe 6 extending co-axially with shaft 10 from end wall 5 and having an outlet opening 25 in end wall 5. In this embodiment separator rotor 30 is provided with radial vanes 31*b* having a similar function to fingers 31 of FIG. 4. A classifier element in the form of classification disc 16 is fitted to and driven in axial rotation by shaft 10. Classifier disc 16 is of generally similar dimension to grinding discs 14 and is provided with similar equiangularly spaced apertures 15A. Classifier disc 16 has a downstream surface 17 and is rotated about the axis of shaft 10. Surface 17 is spaced apart from a second surface 18 (corresponding to the upstream surface of separator rotor 30). First surface 17 is spaced in the axial direction from second surface 18 by a distance "c" which is less than 0.75 and more preferably less than 0.6 of the normal distance "g" between grinding discs 14. The distance "c" between the upstream side of separator rotor 30 and adjacent classifier disc 14 being less than "g" results in a separation angle between rotor 30 and adjacent disc 14 of usually greater than 60°.

Surprisingly, it has been found that when surfaces 17, 18 are closely spaced and the volumetric flow rate through the mill is controlled at a predetermined rate, classification of particles occurs between discs 16 and 30. Finely ground particles and spent media leave the mill via a passage extending through orifice 32 to outlet 6 and coarse particles of useful media remain in the mill, even though no separator screen is provided at outlet opening 25 and the diameter of the outlet is much greater than the largest dimension of the particles retained. Screen clogging is thus eliminated and wear is very significantly reduced because most of the useful media to be retained in the mill is classified out of the slurry before it reaches the separation stage. By careful selection of "c", wear of the separator stage and outlet may be greatly reduced.

It is thought that the classification effect may be explained as follows:

The volumetric flow rate to the mill is controlled at a constant rate by means including a slurry pump and the density of the media is of a similar order of magnitude to that of material being ground in the mill. However the particles of useful media are typically an order of magnitude or more greater in size and mass than the particles of fine ground product. It is believed that the slurry of fine and coarse particles (h) enters the disc-shaped passage 19 defined between classifier disc 16 and separator rotor 30 via apertures 15A of disc 16. Apertures 15A define classifier inlets. Passage 19 has a first classifier outlet or outlets in the form of apertures 32 in disc 30, and a second classifier outlet at the periphery of disc 16.

The angular velocity of a notional layer of fluid adjacent a rotating surface approximates that of the rotating surface but the velocity decreases as a function of distance from the surface in the axial direction. Because first and second surfaces 17, 18 of the classifying stage are more closely spaced in the axial direction than are a pair of grinding discs, the minimum angular velocity of a laminar layer of liquid rotated in passage 19 between the first and second surfaces is considerably greater than the minimum angular velocity imparted to a laminar layer of fluid midway between more widely spaced apart neighbouring grinding discs 14. Rotating first surface 17 (or a layer of liquid associated with surface 17) imparts a force to particles in the slurry stream entering passage 19 via aperture 15A. The component of force (F) acting radially outwardly on a particle of mass m is given by:

$$F=mv^2/r$$

where v is the particle velocity and r is the radial distance from the axis.

For a given velocity, F will increase as particle mass increases and as the particle approaches the axis (i.e. r decreases). There is a particle mass above which the force on the particle is sufficient to disentrain the particle (i) from the slurry flowing towards outlet 32 and to throw the particle outwardly in a substantially tangental direction to leave passage 19 at the periphery of disc 16 ("second classifier outlet"). Vanes 31(*b*) ensure that the flow rate of slurry radially outwardly is greater than the mill throughput flow rate and substantially prevents media entering the passage at the classifier disc periphery and the close spacing of disc 16 to rotor 30 substantially avoids radially inwardly circulation from the disc 16 periphery directed towards the shaft.

Particles of lesser mass (j) remain entrained in the slurry flowing out via apertures 32 ("first classifier outlet"), outlet 25 and pipe 6. Although the embodiment of FIG. 5 has the advantage of simplicity, better results have been obtained by use of various other embodiments as will be hereinafter described.

Figure 6:
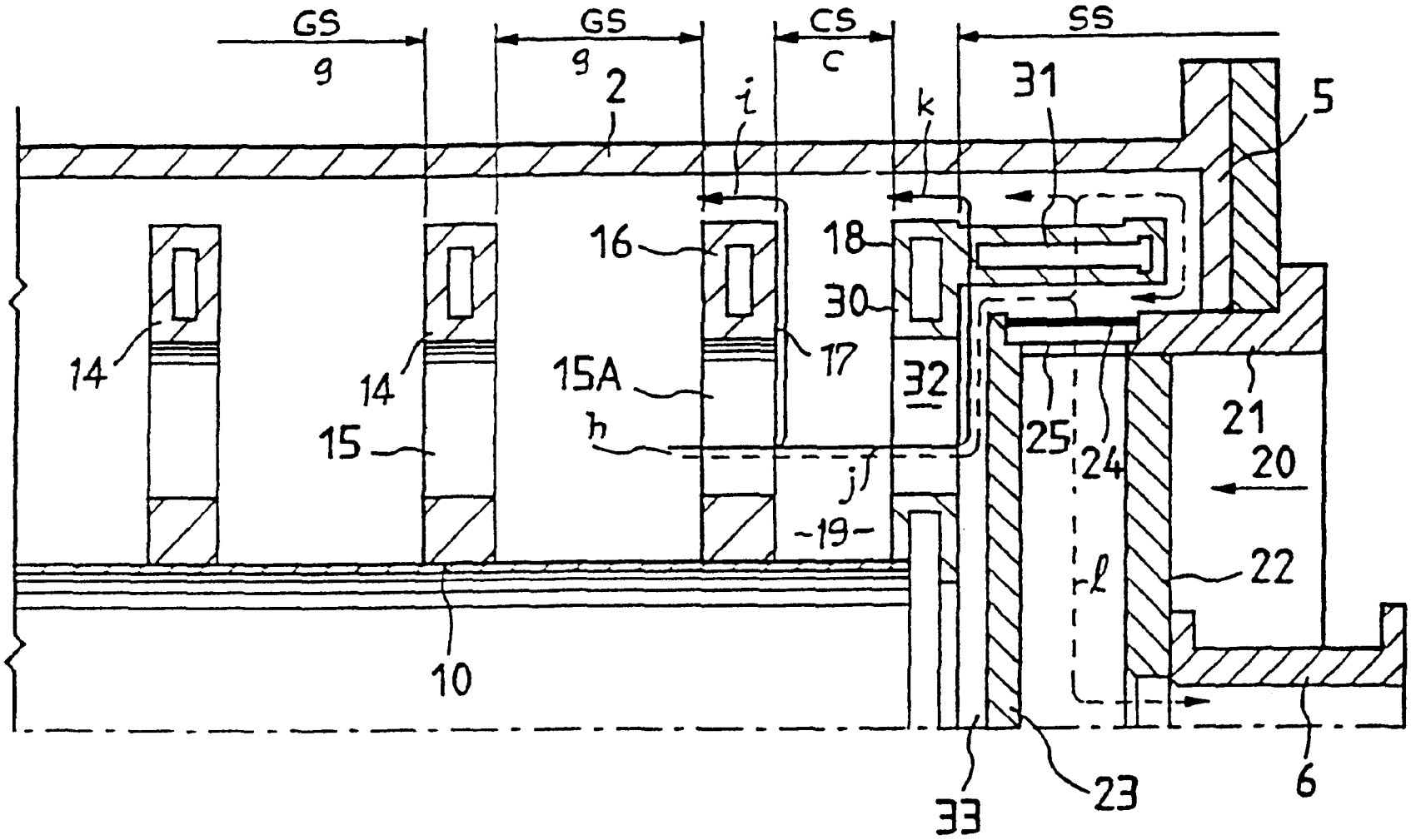
FIGS. 6 to 25 schematically illustrate a further 19 embodiments of the invention in cross sectional elevation.

FIG. 6 shows a second embodiment in which classifier disc 16 is of the similar form to grinding discs 14 and also includes equiangularly spaced apertures 15A. In the embodiment of FIG. 6 classifier disc 16 is closely spaced to a separator rotor 30 which is mounted to the impeller shaft. The apparatus of FIG. 6 differs from that of FIG. 5 in that the radial pumping efficiency of rotor 30 is increased by employing axially extending fingers 31 disposed around a displacement body 23, 24.

The separator stage employs the method used in the embodiment of FIG. 5. Both the first surface 17 and second surface 18 are rotated by the impeller shaft 10. Thus the lower surface 17 of classifier disc 16 constitutes a first surface rotated axially about the axis of shaft 10. The upper surface 18 of adjacent separator rotor 30 is a second surface spaced from and facing first surface 17. Surfaces 17 and 18 are more closely spaced than are grinding rotors 14 and define a cylindrical passage of width "c" ("c" less than "g") therebetween. The separation angle a is greater than 60°.

For example, classifier disc 16 may be of greater than 1 meter in diameter and may be spaced from it's adjacent grinding disc by approximately half the distance between adjacent grinding discs. If the grinding discs are spaced at 400 mm, the classifier disc 16 may be spaced by less than 300 mm and preferably less than 240 mm.

Separator rotor 30 is pierced by equiangularly disposed apertures 32 extending axially through the disc. In addition, separator rotor 30 has fingers 31 extending downwardly and parallel to the axial direction. Classifier disc 16 has similar equiangularly spaced openings 15A which act as classifier stage inlets ("first classifier inlet"). The periphery of classifier disc 16 and separator rotor 30 define a cylindrical outlet to passage 19 defined between first surface 17 and second surface 18 while orifices 32 in separator rotor 30 define a classifier outlet ("first classifier outlet") which is spaced axially from inlet 15A to passage 19.

Slurry (h) enters passage 19 via openings 15A of classifier disc 16 and exits passage 19 via apertures 32 of rotor 30 and outlet opening 25. First and second surfaces 17, 18 directly or indirectly impart angular acceleration to particles in the passage. Fine particles (j) (such as ground product) remain entrained in the slurry flow leaving passage 19 via orifice 32, while heavy particles (i) (such as useful media) are disentrained and move (tangentially) outwards exiting the classifier stage at the periphery of disc 16.

The fine particles (j) pass from the downstream classifying orifice 32 to outlet 6 via a narrow passage 33 to the upstream side of screen 25, thence through screen openings 25, and into outlet pipe 6. The narrowest dimension of these passages is the openings at screen 25, the dimensions of which are much greater than that of the fine particles.

The classification stage thus utilises the same principle as discussed in relation to the embodiment of FIG. 5.

Desirably, a secondary classification may be conducted in the separator stage. For example, slurry (j) exiting passage 19 via apertures 32 ("first classifier outlet") enters into radially extending separation passage 33 defined between the downstream surface of separator rotor 30 and the upper surface of displacement body inner plate 23. Apertures 32 are thus both the classifier stage outlet and the separator stage inlet. The slurry is admitted into separator passage 33 at a location close to the impeller axis and flows in a radially outward direction towards peripheral fingers 31. The slurry then flows into axial passage 34 between opening 25 and fingers 31 and flows out via cylindrical opening 25 into outlet pipe 6. Both coarse and fine particles are accelerated by rotation imparted by separator rotor 30. Particles (k) of mass greater than a predetermined mass (primarily useful media) acquire a momentum in a radially outward direction such that they become disentrained from the slurry as the slurry changes direction into axial passage 34 to flow out via outlet 25. These particles of greater mass exit separation passage 33 at an outlet located at the passage periphery, pass between fingers 31 and are oriented radially and return to chamber 1. Fine particles (1) below the predetermined mass remain entrained as the slurry leaves radial passage 33 at an outlet defined by axial passage 34 to opening 25 and exit the mill. Opening 25 does not require a screen. However it is advantageous to provide a grate in order to provide flow resistance. The grate does not act as a classifying screen and may have openings which are much greater than the maximum dimension of useful grinding media or unground product. For example openings of 2 mm or 20 mm may be used notwithstanding that useful grinding media down to, for example a maximum dimension of 0.9 mm, (or in some cases less) is to be retained.

The separation or "secondary classification" which occurs in the separator stage of FIG. 6 thus employs a different principle of operation from the upstream classifier stage. In the separator stage, both fine and coarse particles are accelerated radially outwardly, but because the momentum of the coarse particles is greater, they become disentrained when the slurry flow direction changes from a radial to an axial flow direction. The combination of a classification and a separation (secondary classification) stage has been found to be particularly effective.

Figure 7:
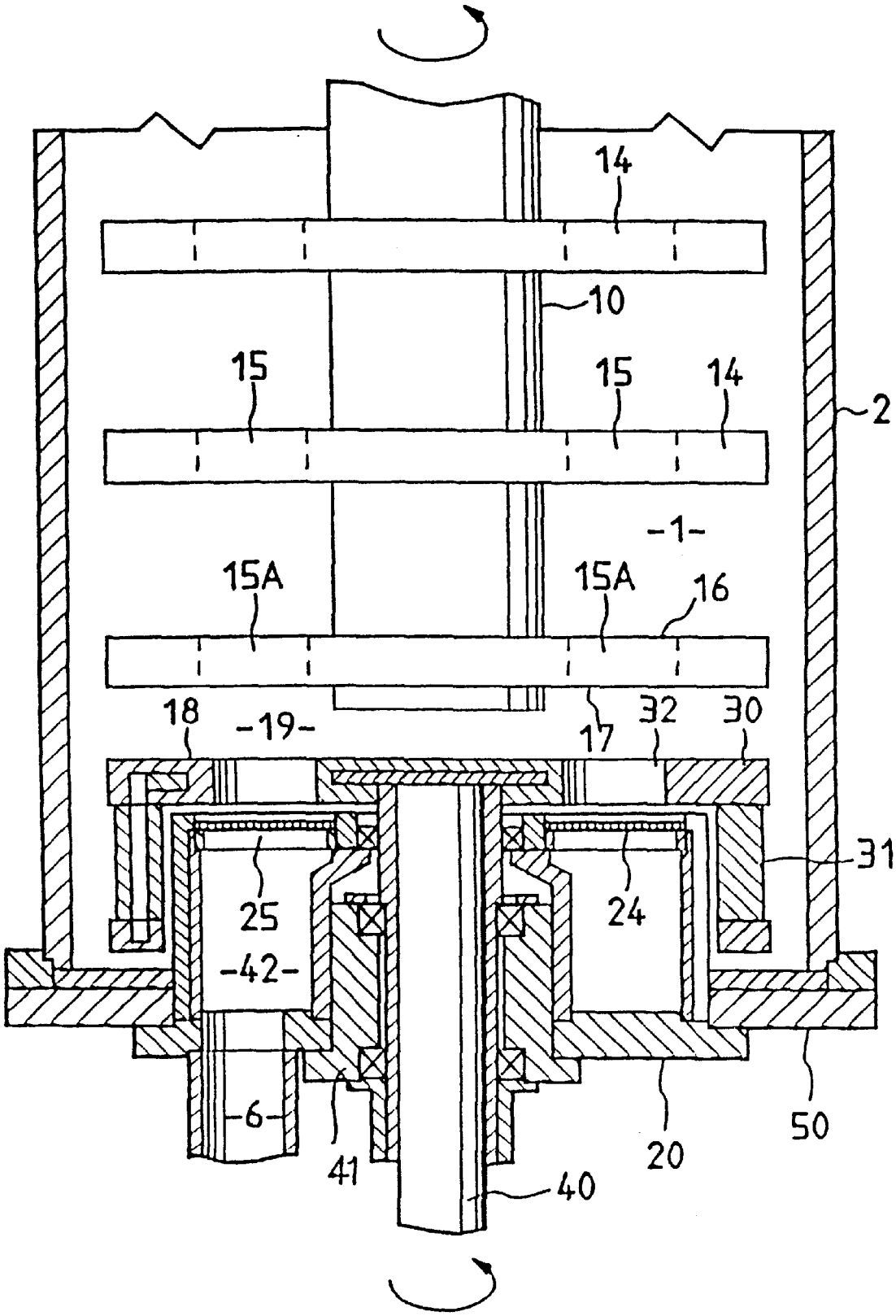

In a further embodiment as illustrated in FIG. 7, separator rotor 30 is not driven from impeller shaft 10 but instead is independently driven via a second drive shaft 40 which extends through a gland 41 in lower end wall 20 and is driven by means not illustrated. Separator rotor 30 is provided with equiangularly spaced orifices 32 which overlie an annular outlet chamber 42 communicating with outlet pipe 6. Outlet chamber 42 may optionally be provided with a covering screen 24, but (if employed) screen 24 does not perform a separating or classifying function, as particles are classified upstream of the outlet primarily between surface 17 of classifier disc 16 and surface 18 of the separator rotor as previously described.

It will be noted that in the embodiment of FIG. 7 the separator rotor 30 may be driven at a different speed from impeller shaft 10 and classification disc 16. Impeller shaft 10 may therefore be driven at a speed selected to optimize grinding at or between discs 14, while separator rotor 30 may be driven at a different speed selected so as to influence the particle size cut, or more accurately, the critical mass which determines whether a particle is entrained in the slurry flow to the mill outlet or is rejected upstream of the outlet and thus retained in the mill.

Figure 8:
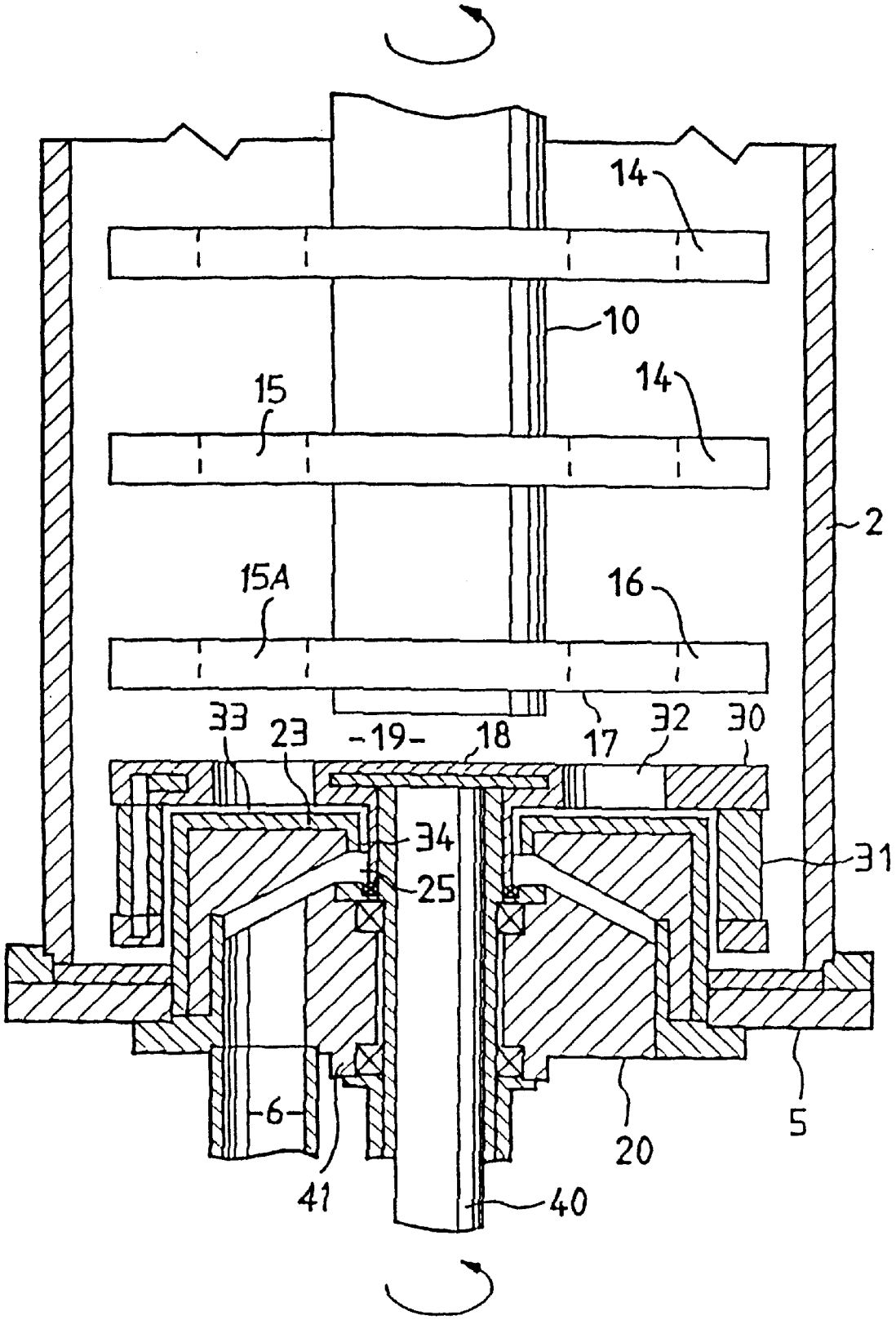

The embodiment of FIG. 8 differs from that in FIG. 7 in respect of the secondary classification occurring in the separation stage. Flow from orifices 32 of separator rotor 30 is directed via a radially extending separator passage 33 defined between the downstream surface of separator rotor 30 and facing end plate 23, towards an axially extending passage 34 which is situated adjacent to shaft 40 radially inwardly of orifice 32. The fines then exit via opening 25 communicating with pipe 6. Orifice 32 thus acts as an (first classifier) outlet for the classification stage and as an inlet to the separator stage (secondary classification stage). The periphery of radial passage 33 provides a passage outlet which is radially orientated whereby coarse (heavy) particles are returned to the mill. Passage 34 provides a peripheral second passage outlet through which fine (light) particles exit entrained with the slurry.

Figure 9:
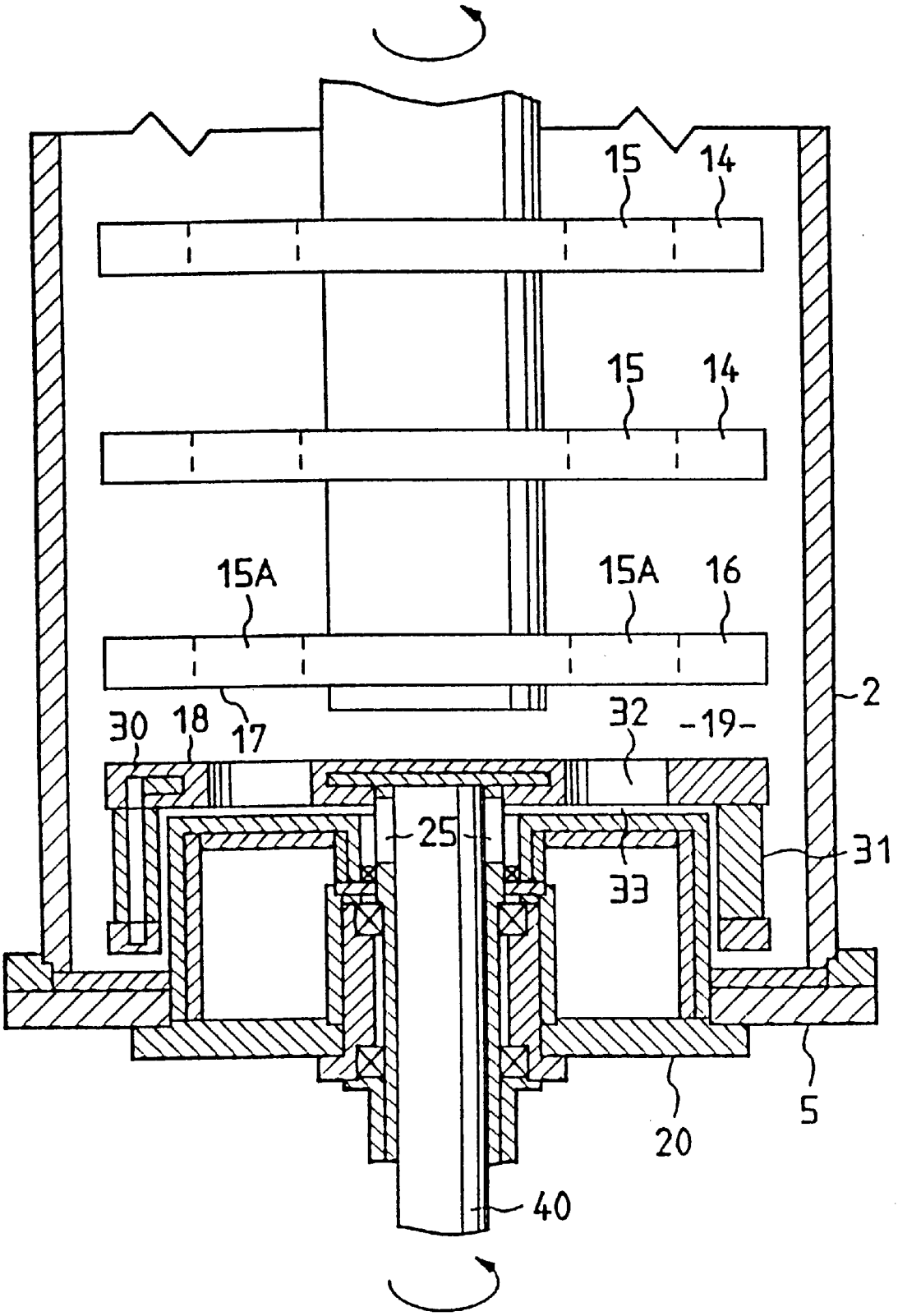

The embodiment of FIG. 9 differs from that of FIG. 8 in that slurry flows from orifice 32 into a radially extending passage 33 and, via openings 25, leaves the mill through hollow drive shaft 40, which is in fluid communication with the openings 25. The embodiments of FIGS. 8 and 9 provide a separation (or secondary classification) in which particles entering axial passage 33 defined between the undersurface of separator rotor 30 and end plate 23 are subjected to angular acceleration. Fine particles are entrained with the radially inward slurry flow towards the second passage outlet and coarse particles may be disentrained and exit outwardly at the first passage outlet between fingers 31.

Figure 10:
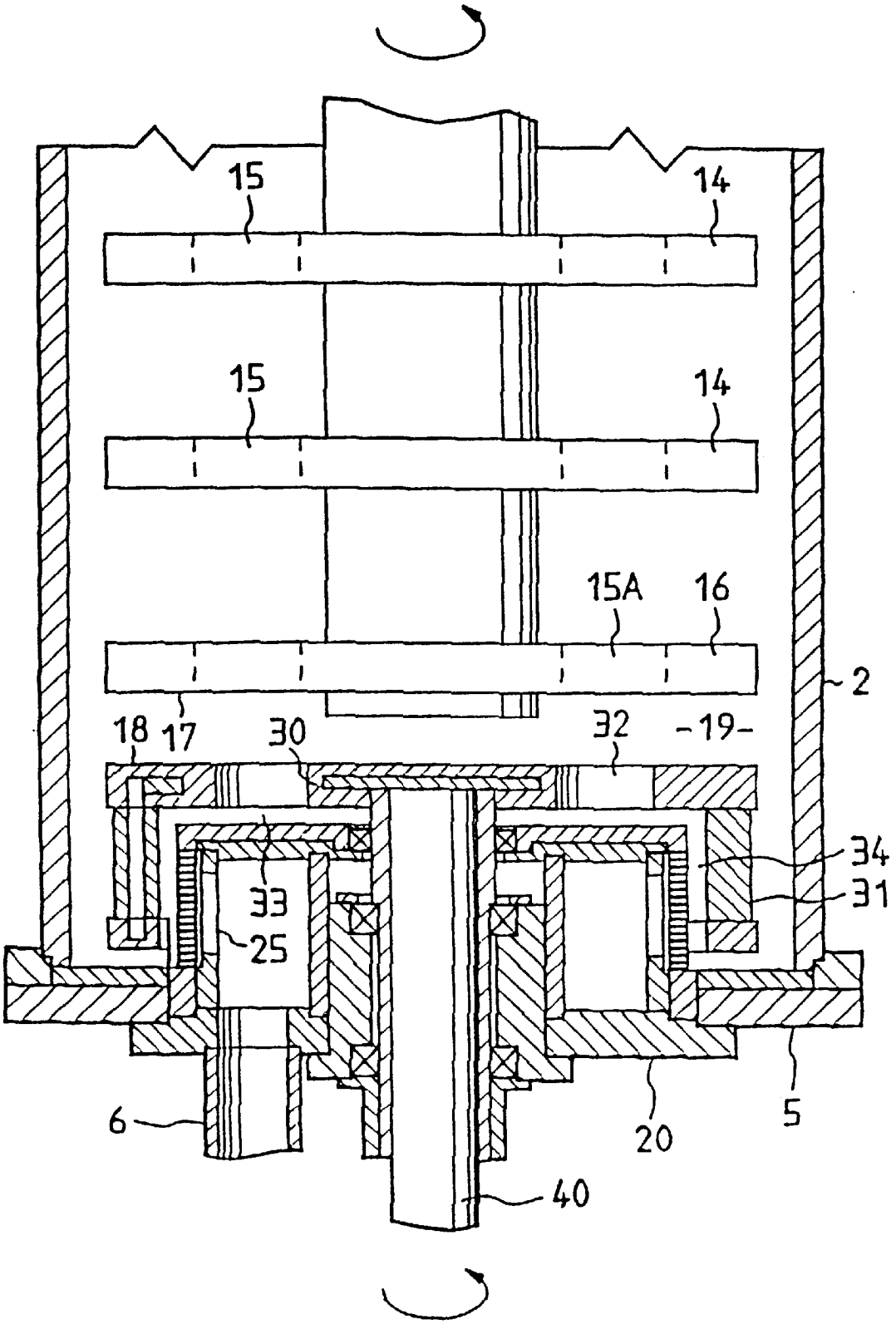

The embodiment of FIG. 10 differs from that of FIGS. 8 and 9 in that slurry entering radial passage 33 via separator stage inlet orifice 32 flows radially outwardly prior to exiting the mill via axial passage 34 and opening 25 which does not have an outlet screen. The momentum of coarse (heavier) particles carries them out at a first opening at the periphery of passage 33 in a manner similar to that previously described with reference to the embodiment of FIG. 6 while fine (lighter) particles leave passage 33 at a second opening.

Figure 11:
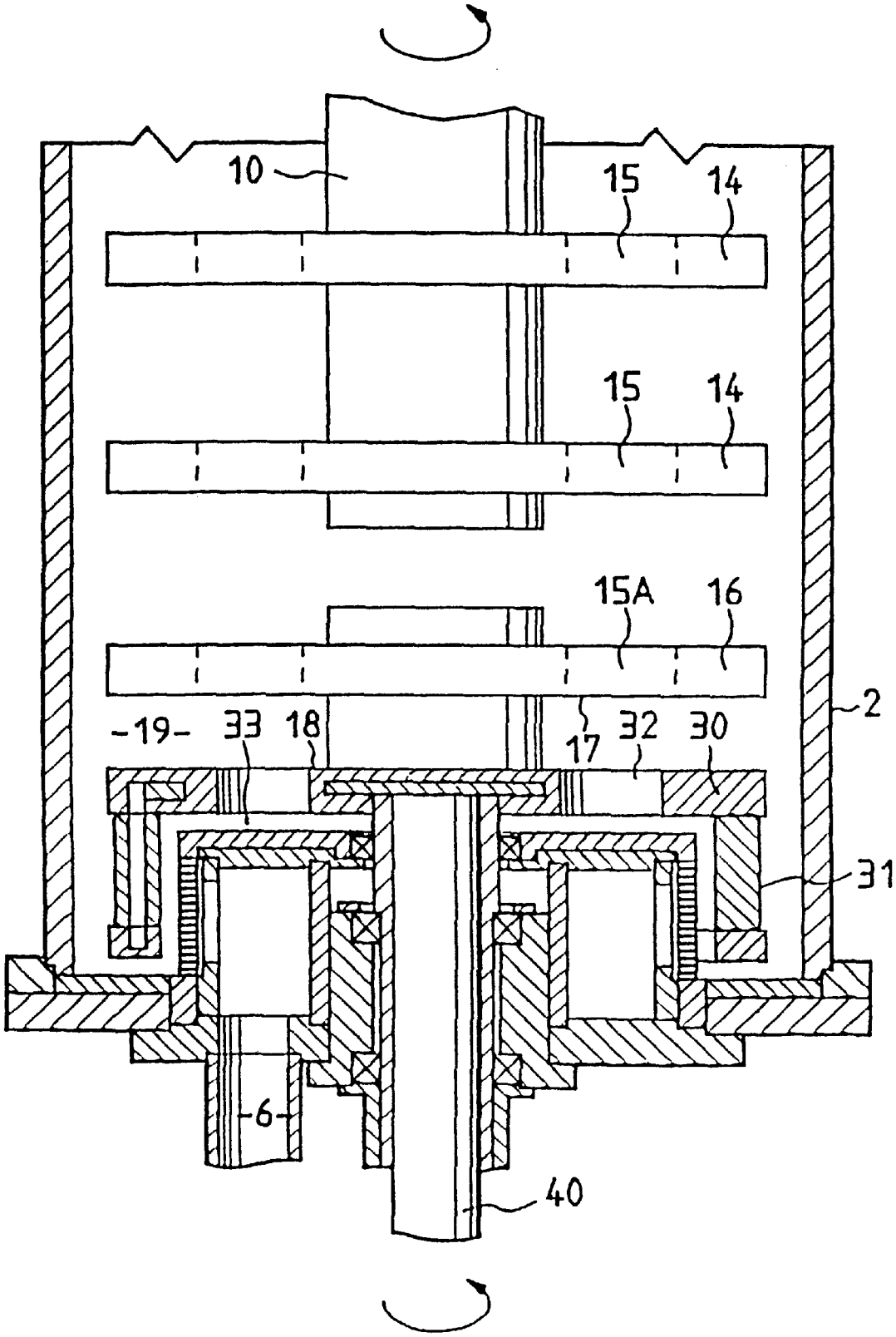
Figure 12:
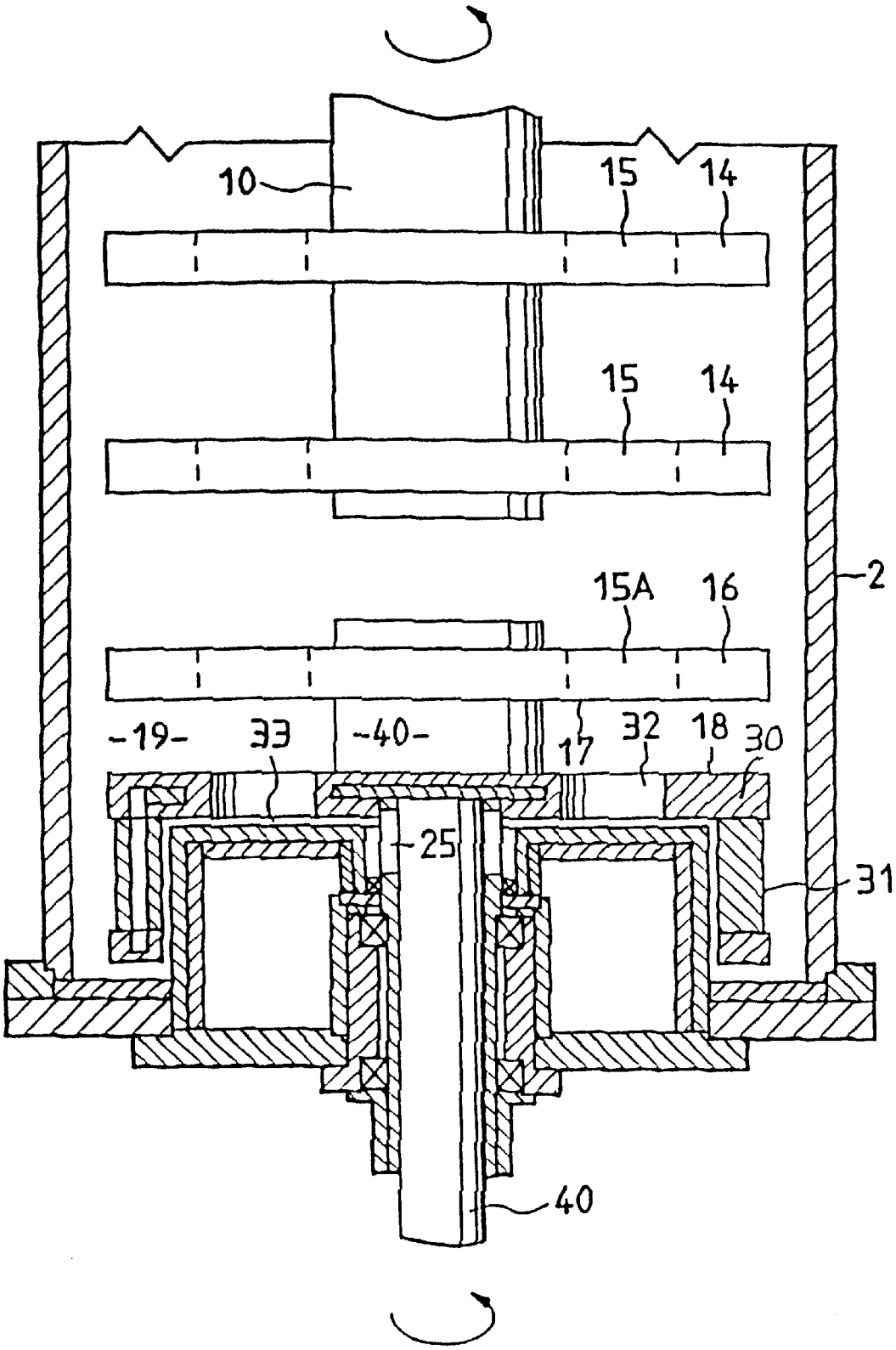
Figure 13:
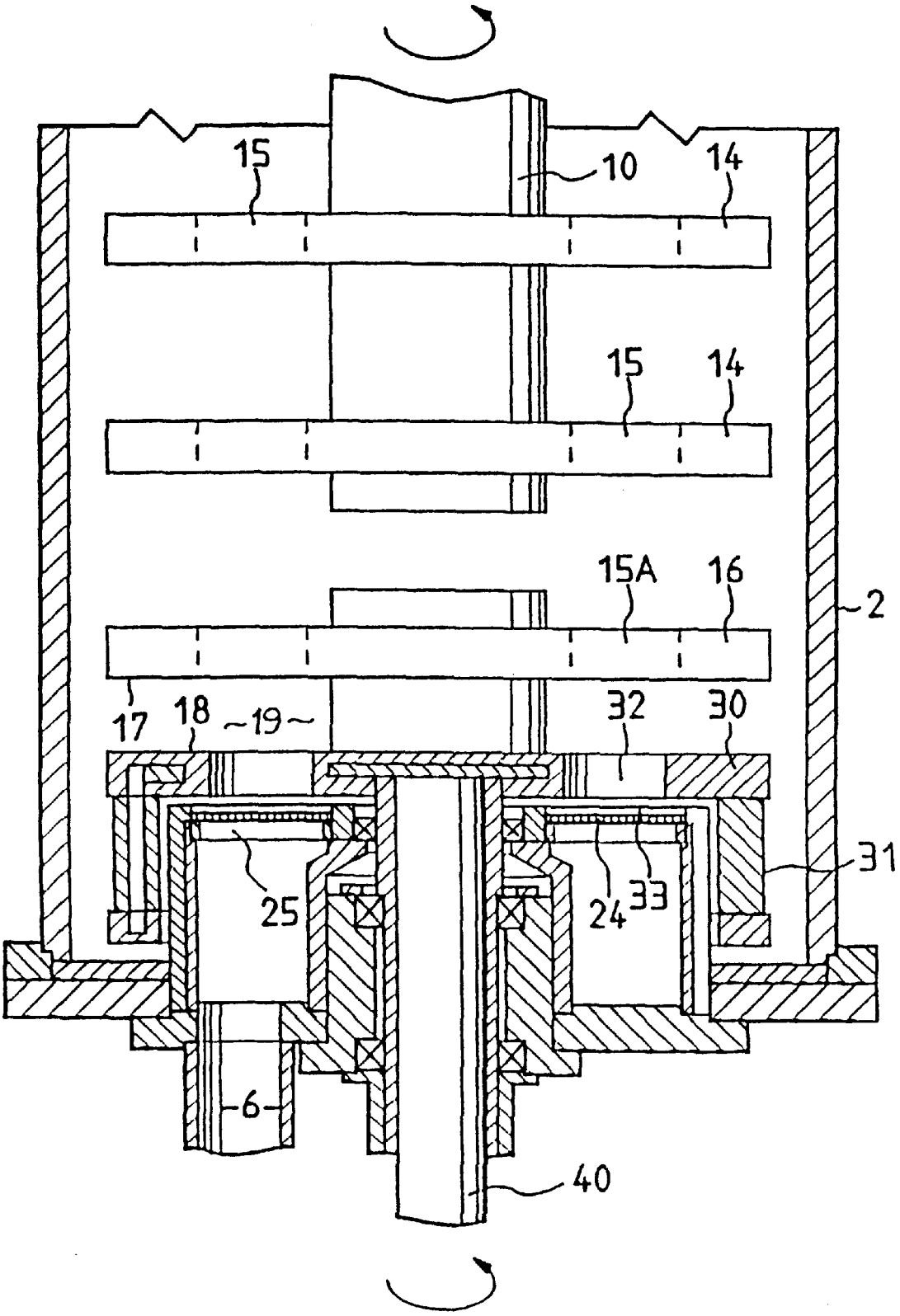

The embodiment of FIGS. 11 and 12 differs from those so far described in that a classifier disc 16 and an separator rotor 30 are both driven by a drive shaft 40 and independently of impeller shaft 10. In this embodiment impeller shaft 10 is driven at an optimum speed for grinding and classifier disc 16 is driven at a desired speed for achieving optimum separation of useful media from product particles and spent media. If desired, an additional classification stage may be provided between the underside of the last grinding disc 14 and the upper surface of a classification rotor 16 by spacing these discs more closely together. Alternatively these discs may be separated sufficiently (for example with a separation angle of less than 60°) to promote grinding therebetween. The primary classifier arrangement of FIGS. 11 and 12 may employ various separation (secondary classification) systems. Thus in FIG. 11, passage 33 has an outlet into hollow drive shaft 40 i.e. the separator stage outlet is axially inwards of separator stage inlet aperture 32. In FIG. 12 the separator stage outlet is reached via a radially outward flow from aperture 32 in passage 33. In FIG. 13 flow from the primary classifier exits directly via aperture 32 into the underlying outlet chamber 42. In each of the embodiments classification occurs between disc 16 and rotor 30.

Figure 14:
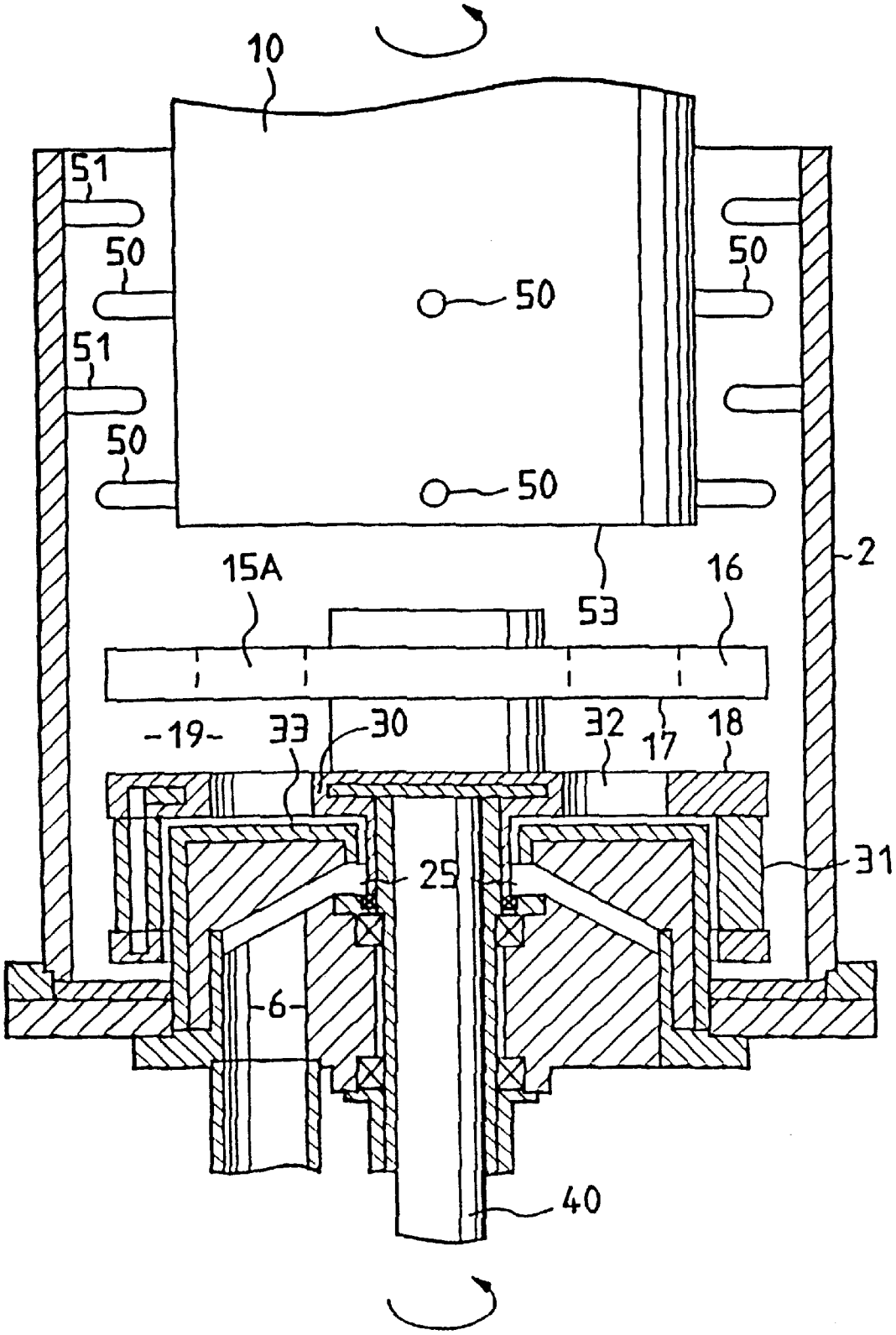

In FIG. 14 there is shown a peg mill employing a classifier according to the invention in combination with a separator for secondary classification. The mill differs from those previously described in that grinding discs 14 are replaced by pegs 50 extending radially outwardly from a drive shaft or a drum 10 of greater diameter than the shaft of previously described mills. Pegs 51 extend radially inwardly from the chamber wall in an interdigital configuration relative to pegs 50. In the embodiment of FIG. 14, classification is provided between the undersurface 17 of disc 16 and the upper surface 18 of separator rotor 30 while separation or secondary classification may be provided between the underside of rotor 30 and end plate 20. If desired, further classification may be provided by closely spacing the lower end surface 53 of the peg mill drive shaft 10 closely with the facing upper surface of classifier disc 16. Various separation or secondary classification systems previously herein described in relation to disc grinding mills may also be employed with the peg mill.

Figure 15:
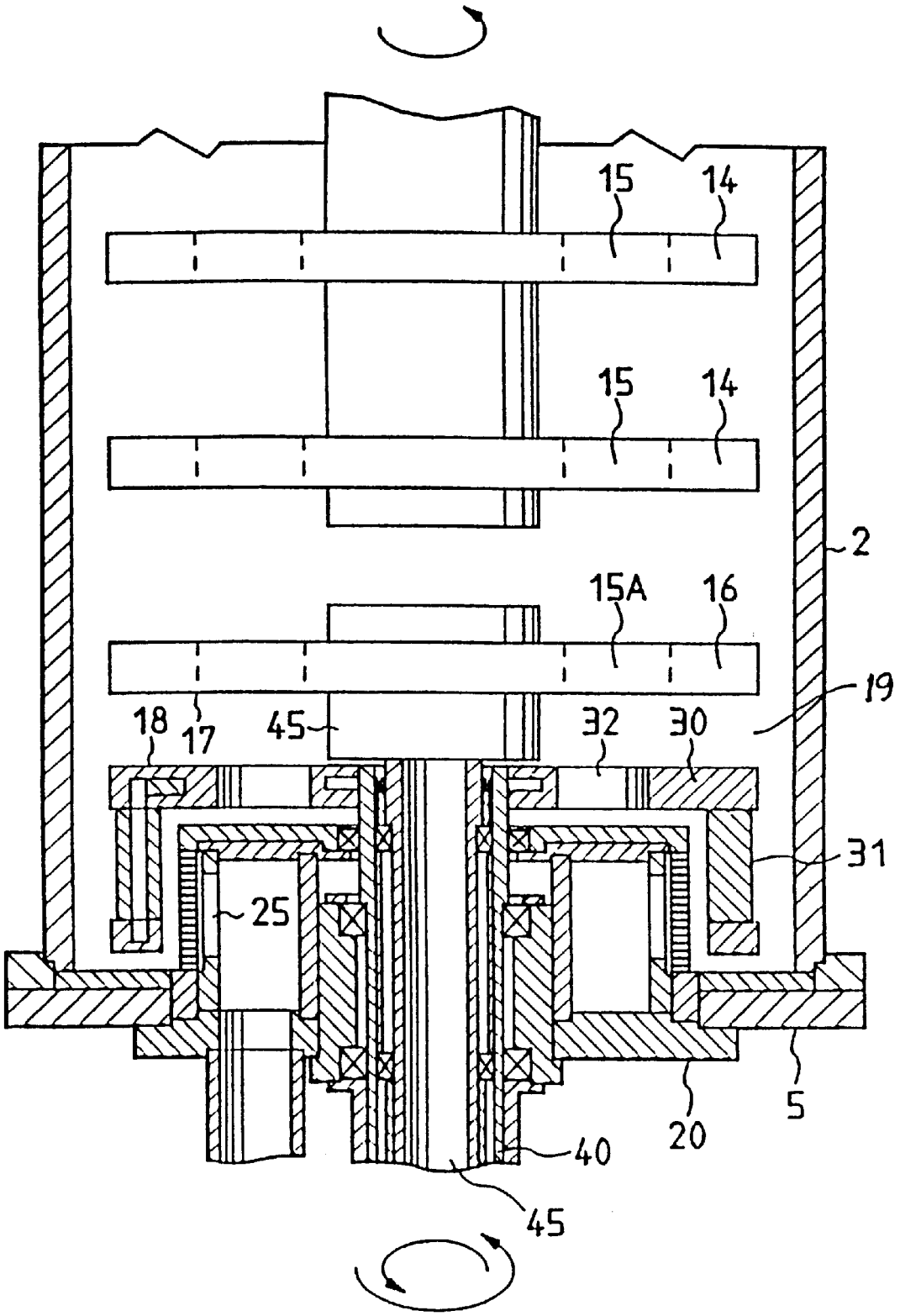
Figure 16:
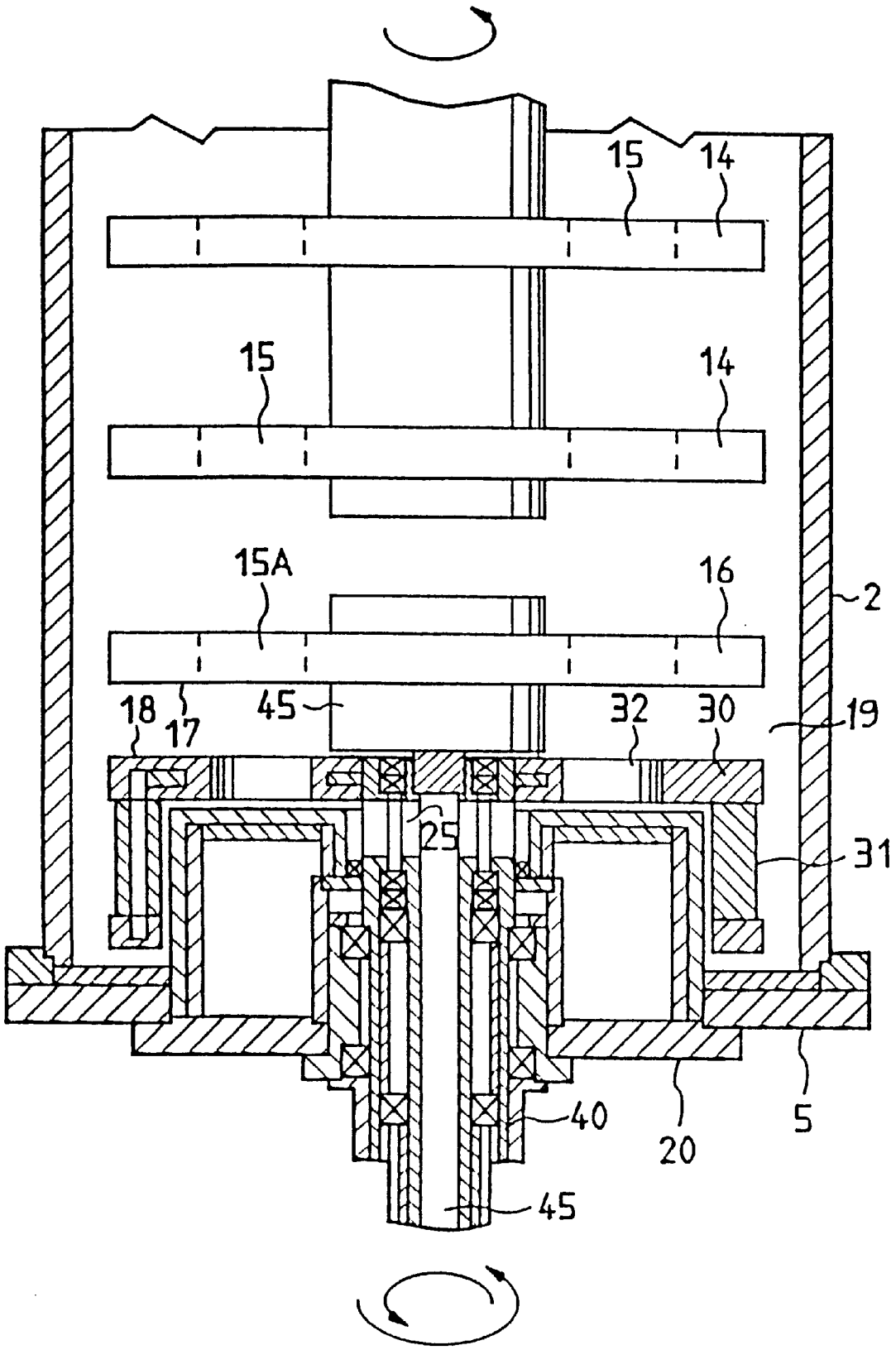
Figure 17:
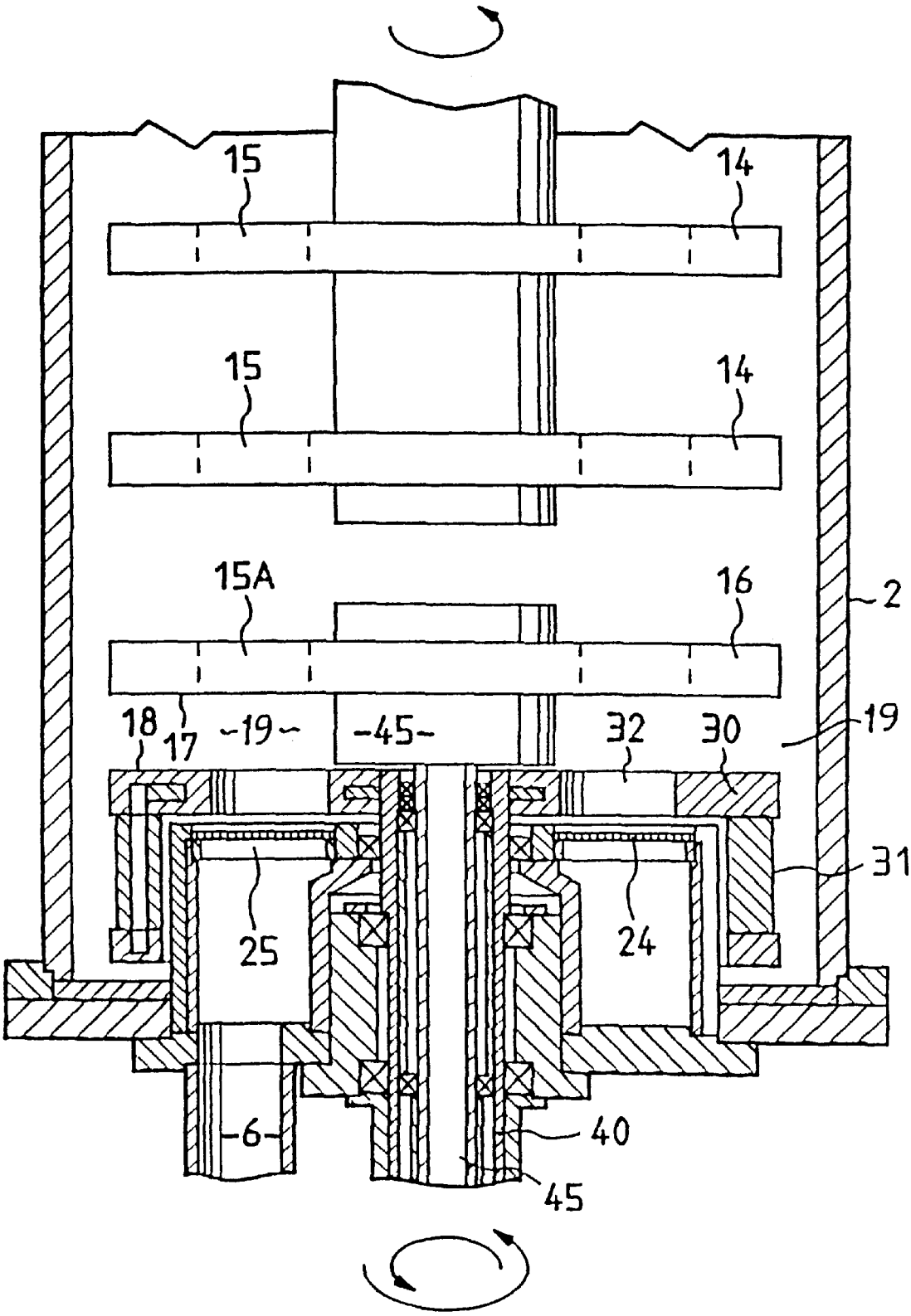
Figure 18:
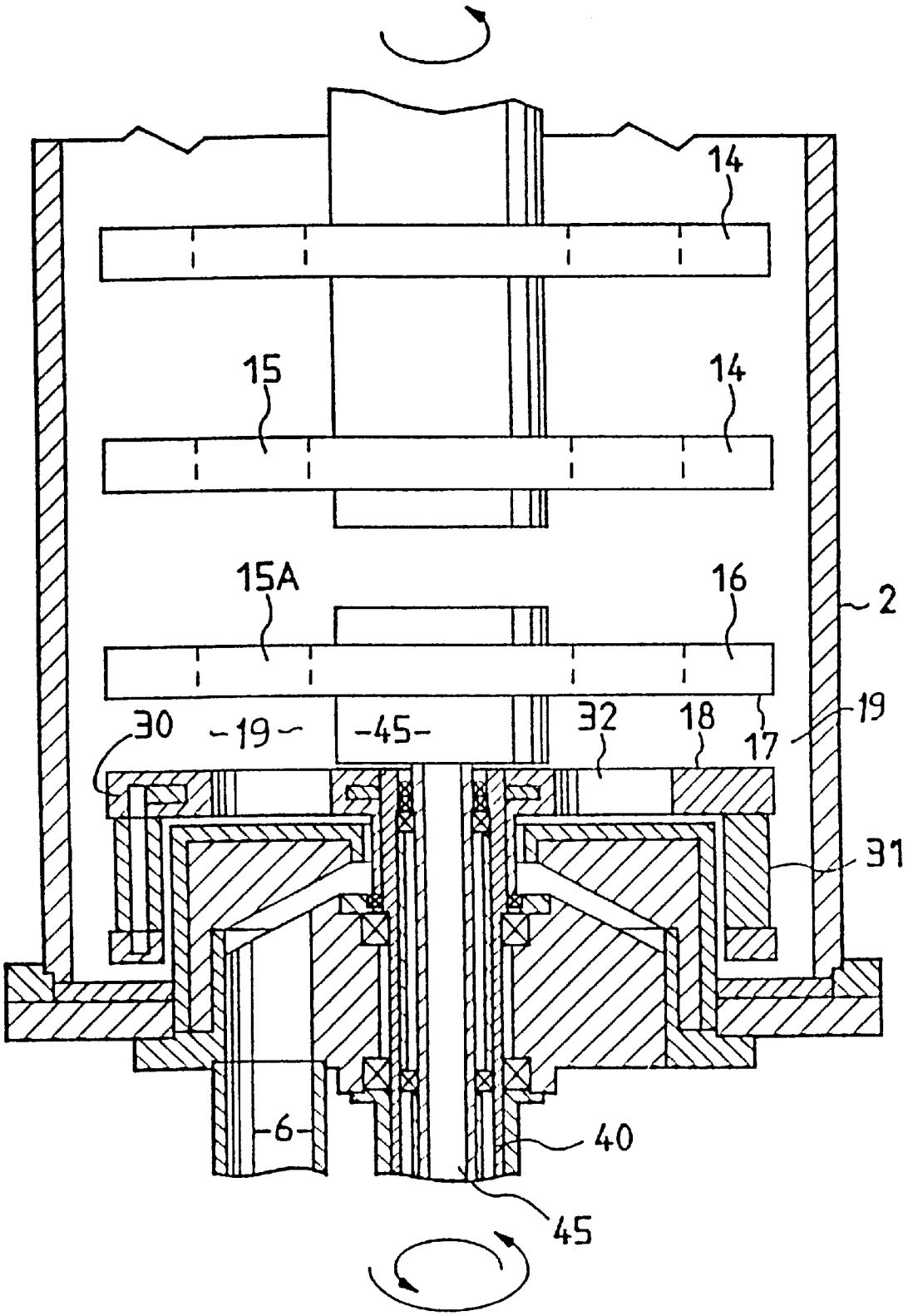

As shown in the embodiments of FIGS. 15 and 16, classifier disc 16 may advantageously be driven by a drive shaft 45 concentric with and independently from separator rotor 30 driven by shaft 40 as well as independently from the grinding discs 14 driven by shaft 10. Thus the impeller shaft 10 may be rotated at a speed selected to promote grinding efficiency, the classifier disc 16 may be driven by shaft 45 at a speed selected to provide for primary classification and the separator rotor 30 may be driven by shaft 40 at an optimum speed for separation or secondary classification. If desired one of the shafts (e.g. 45) may be driven in counter rotation to the others. The embodiments of FIGS. 15 and 16 exemplify arrangements in which the separator or secondary classification outlet is disposed radially outwardly from aperture 32 (FIG. 15) or radially inwardly from aperture 32 (FIG. 16). In the latter case the slurry exits via a hollow shaft 45. The embodiments of FIGS. 17 and 18 have separator or secondary classification stages similar to FIGS. 7 and 8.

Figure 19:
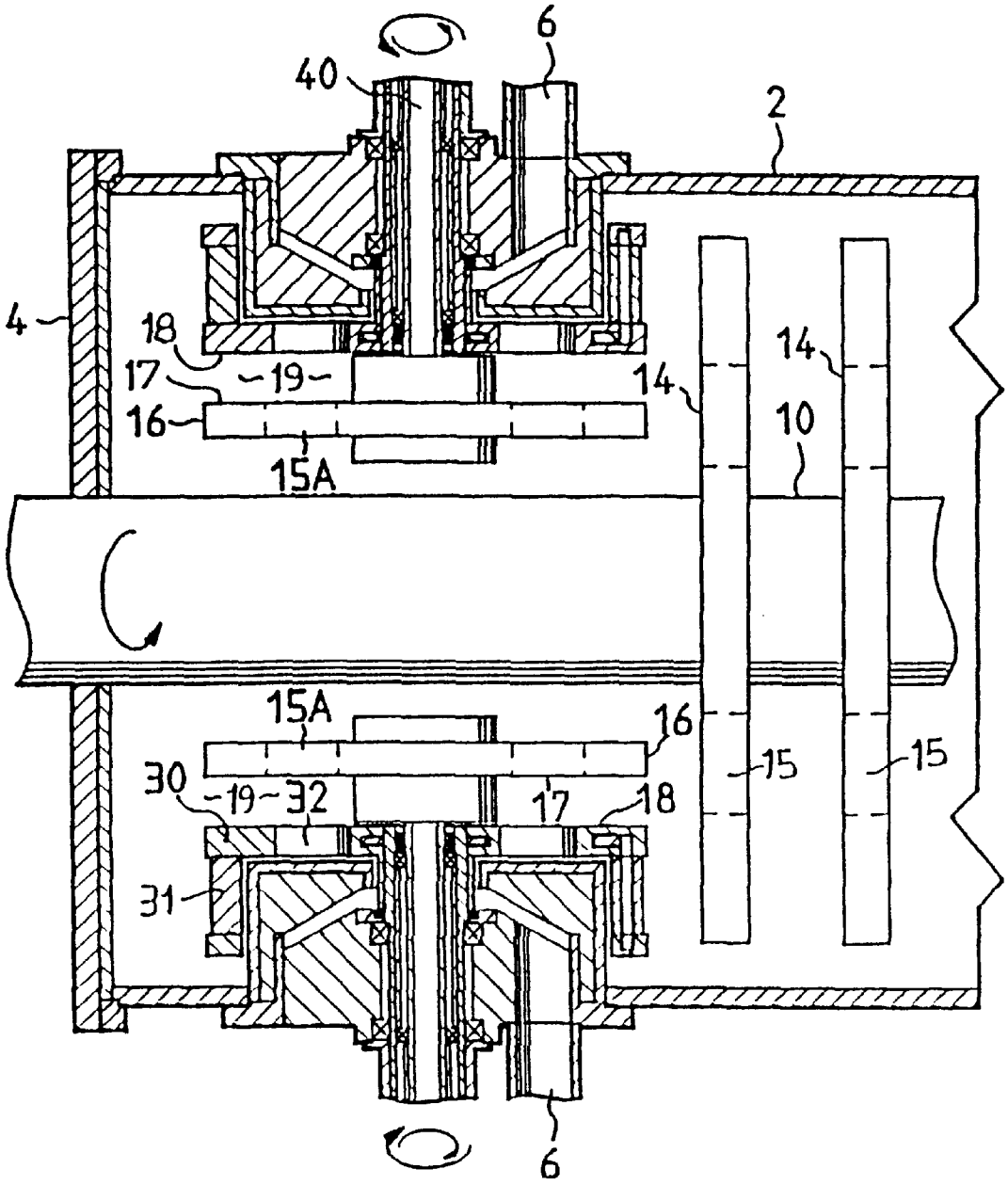
Figure 20:
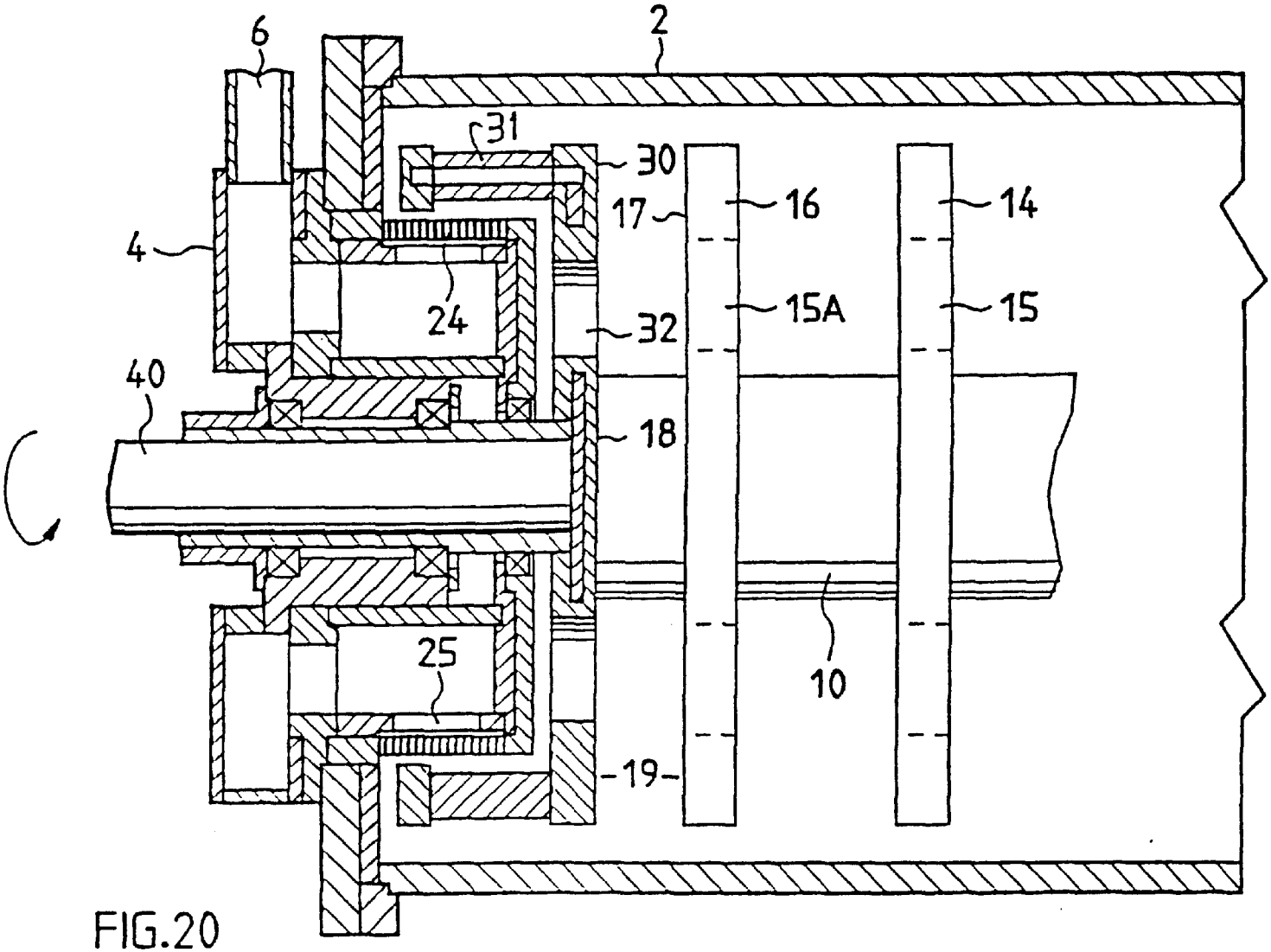

With reference to FIG. 19, there is shown an embodiment in which slurry outlets are disposed on the mill wall, rather than at the mill chamber ends and in which the classifier operates with members rotating about an axis at right angles to the axis of shaft 10. FIG. 20 shows an arrangement in which the slurry outlet is located at the roof (drive end) of the mill rather than adjacent the floor and in which the final separation may be gravity assisted.

Figure 21:
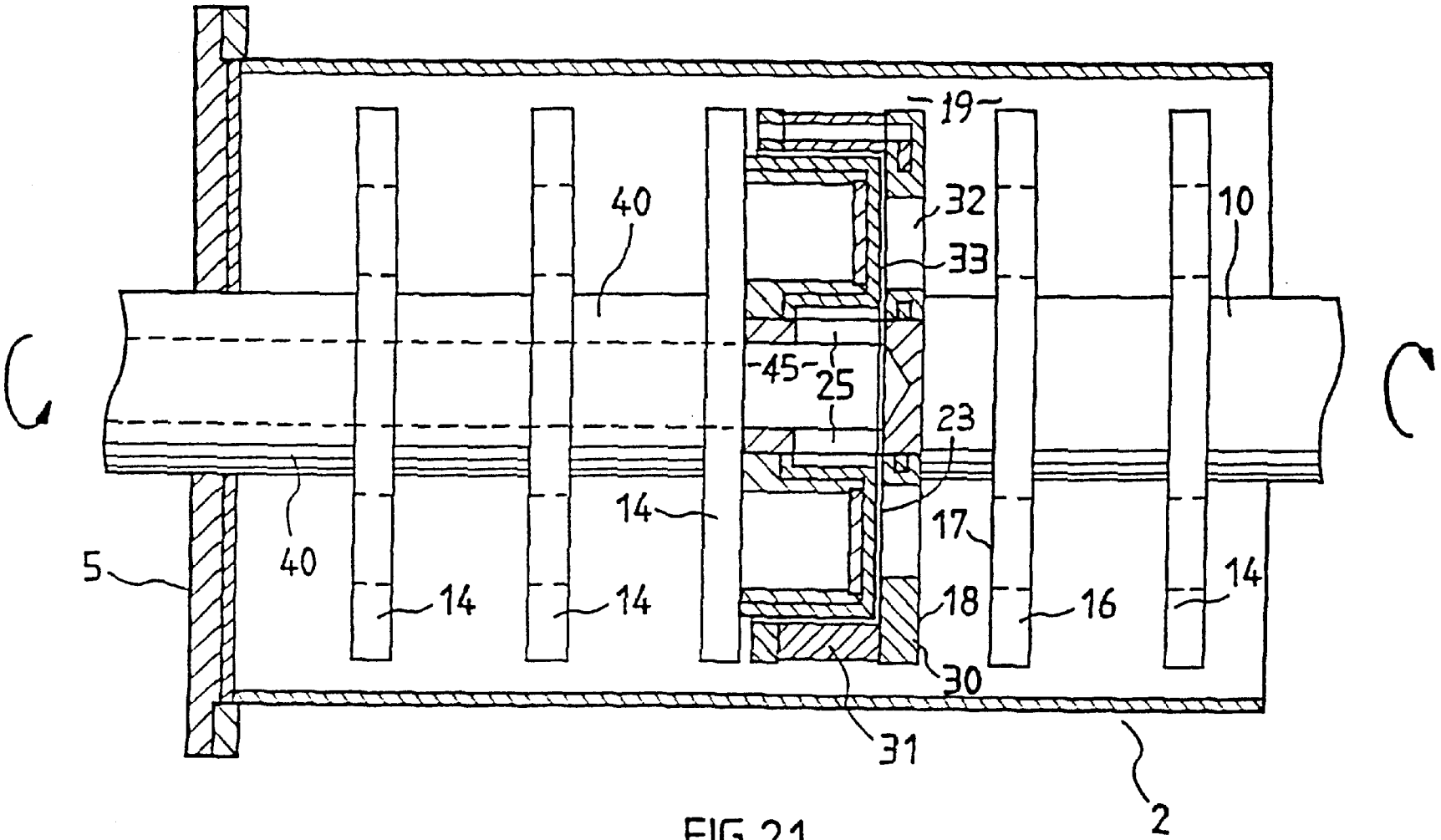

FIG. 21 shows an embodiment in which the classifier is situated substantially centrally in a mill fed from each end and having an outlet disposed between the ends. In this embodiment the separation or secondary classifier outlet flow is via hollow shaft 45. Displacement body 20 is replaced by an arrangement defining outlet 25 and mounted to hollow shaft 45 thus providing for further variation in speed as between separator rotor 30 and the opposite side 23 of passage 33. Classification occurs as previously described between classification disc 16 and rotor 30. Alternatively both disc 16 and rotor 30 of the outlet arrangement can be driven by a single hollow shaft.

Figure 22A:
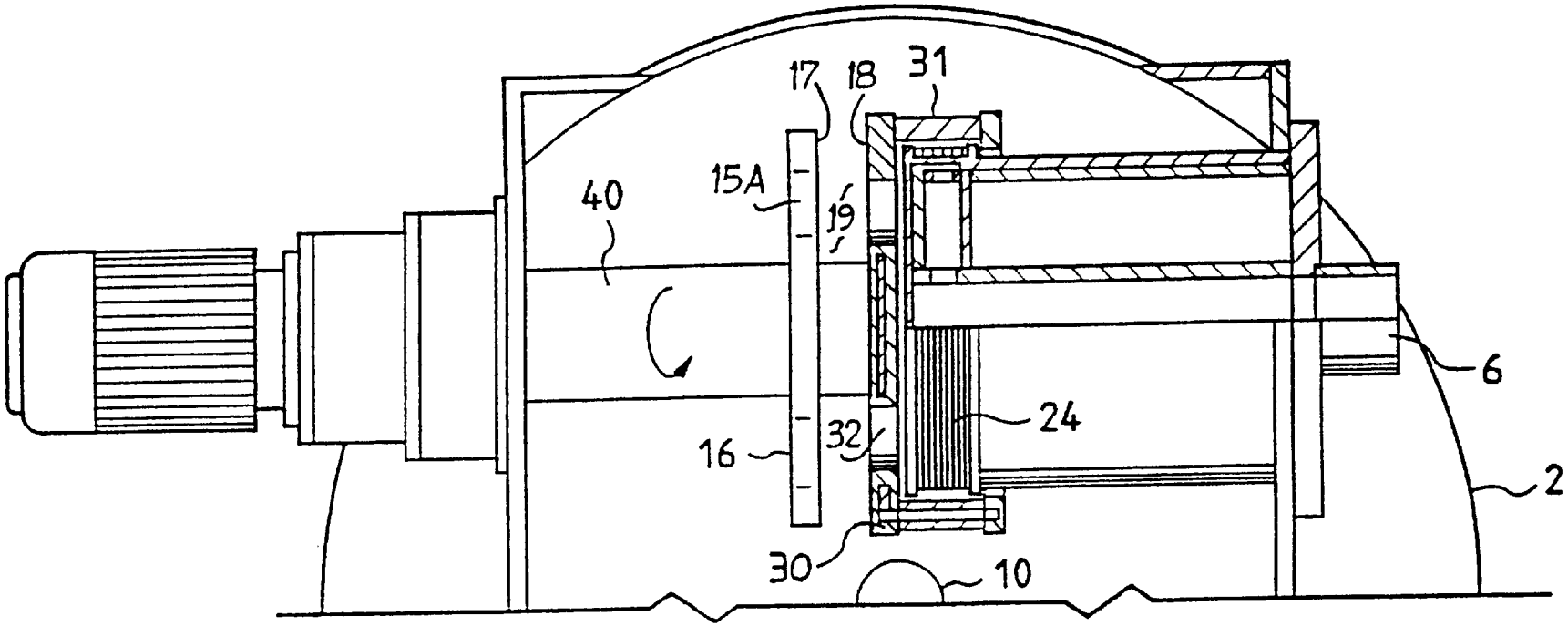
Figure 22B:
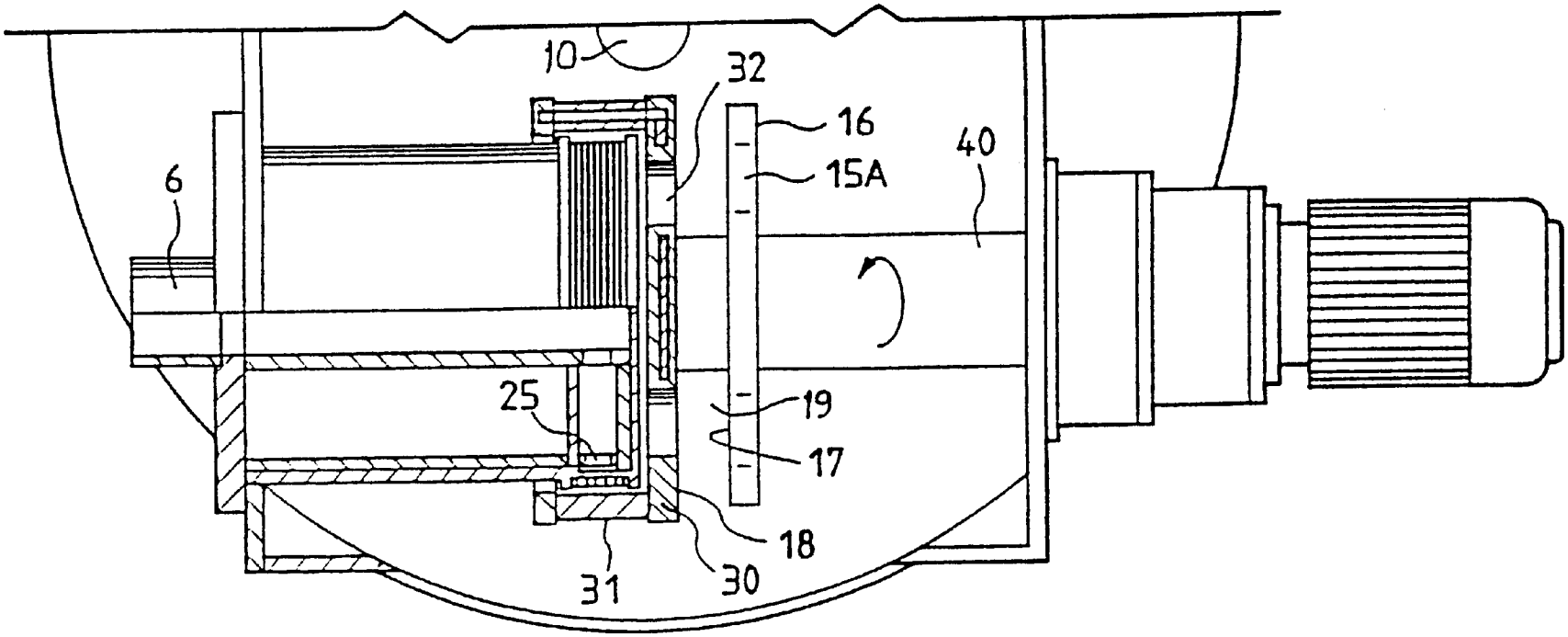
Figure 23:
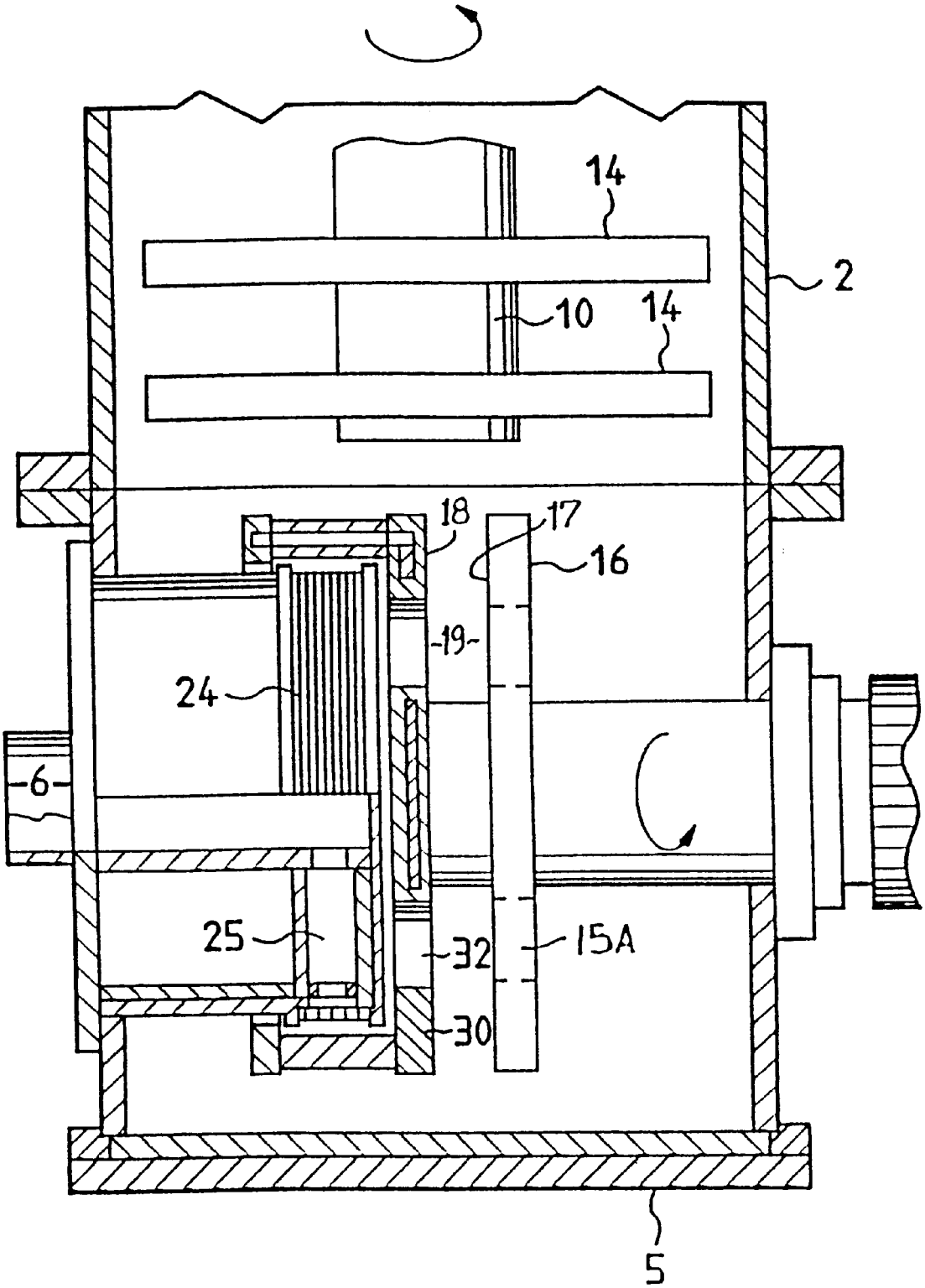

FIG. 22 (shown separated into FIGS. 22A and 22B for clarity) and FIG. 23 show various arrangements in which a primary classifier (and optional separator or secondary classifier) is (or are) disposed about an axis at right angles to impeller shaft 10.

Figure 24:
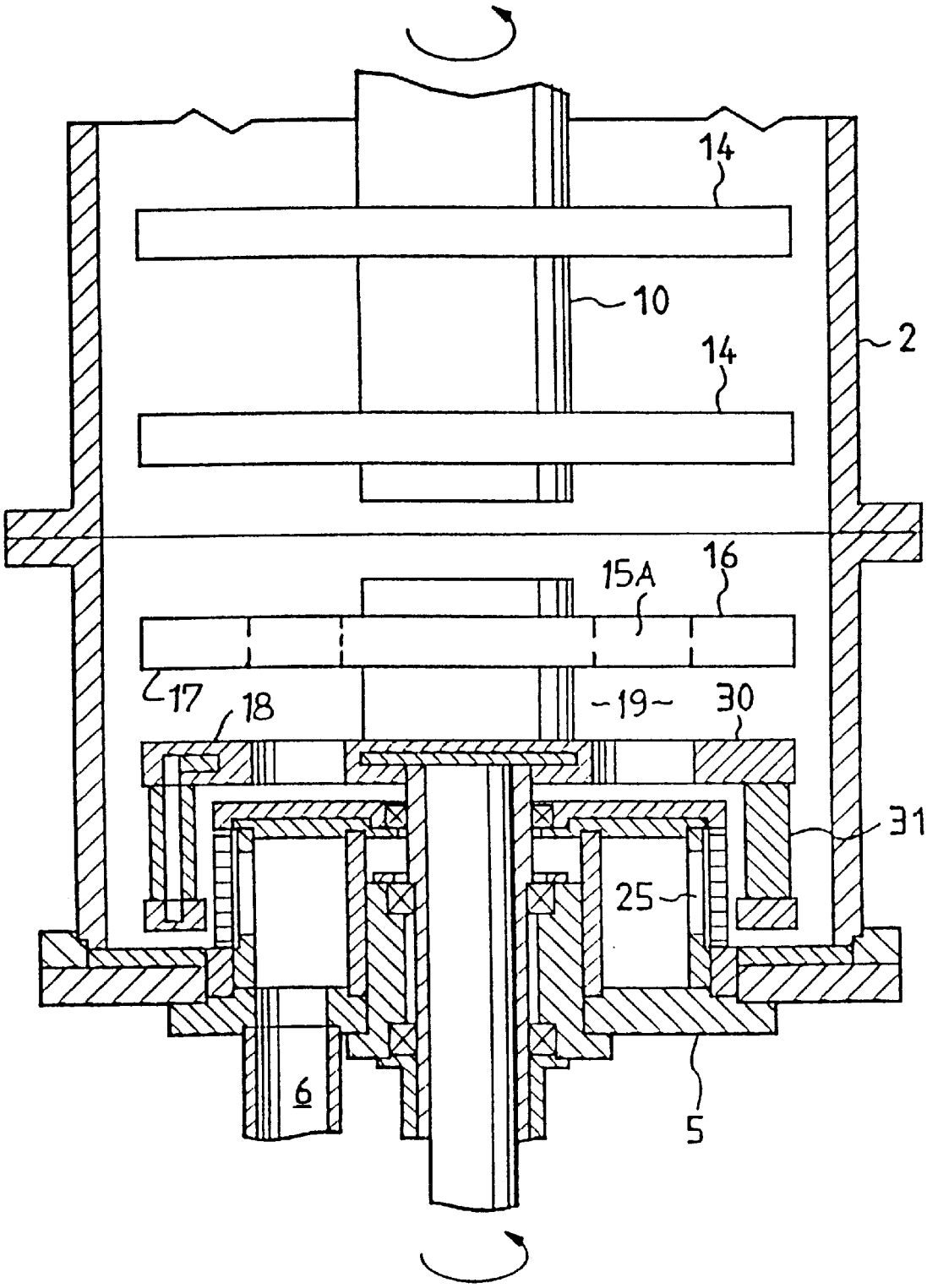

As illustrated in FIGS. 23 and 24 the classification and separator sections may be housed within a cylindrical housing which is flange-mounted at 54 to the main cylindrical wall of the mill and which enables the mill wall to be replaced without the need to replace the classification system or vice versa. The classifier disc 16 or other parts of the classifier or separator system may be of a diameter different from that of the grinding elements. In other embodiments not illustrated a classification system similar to that shown in FIG. 25 may be mounted to mill wall 2 by means permitting adjustment of the distance between grinding disc 14 and classification disc 16. For example the separator system housing may be threadably connected to the mill wall to provide such adjustment.

Figure 25:
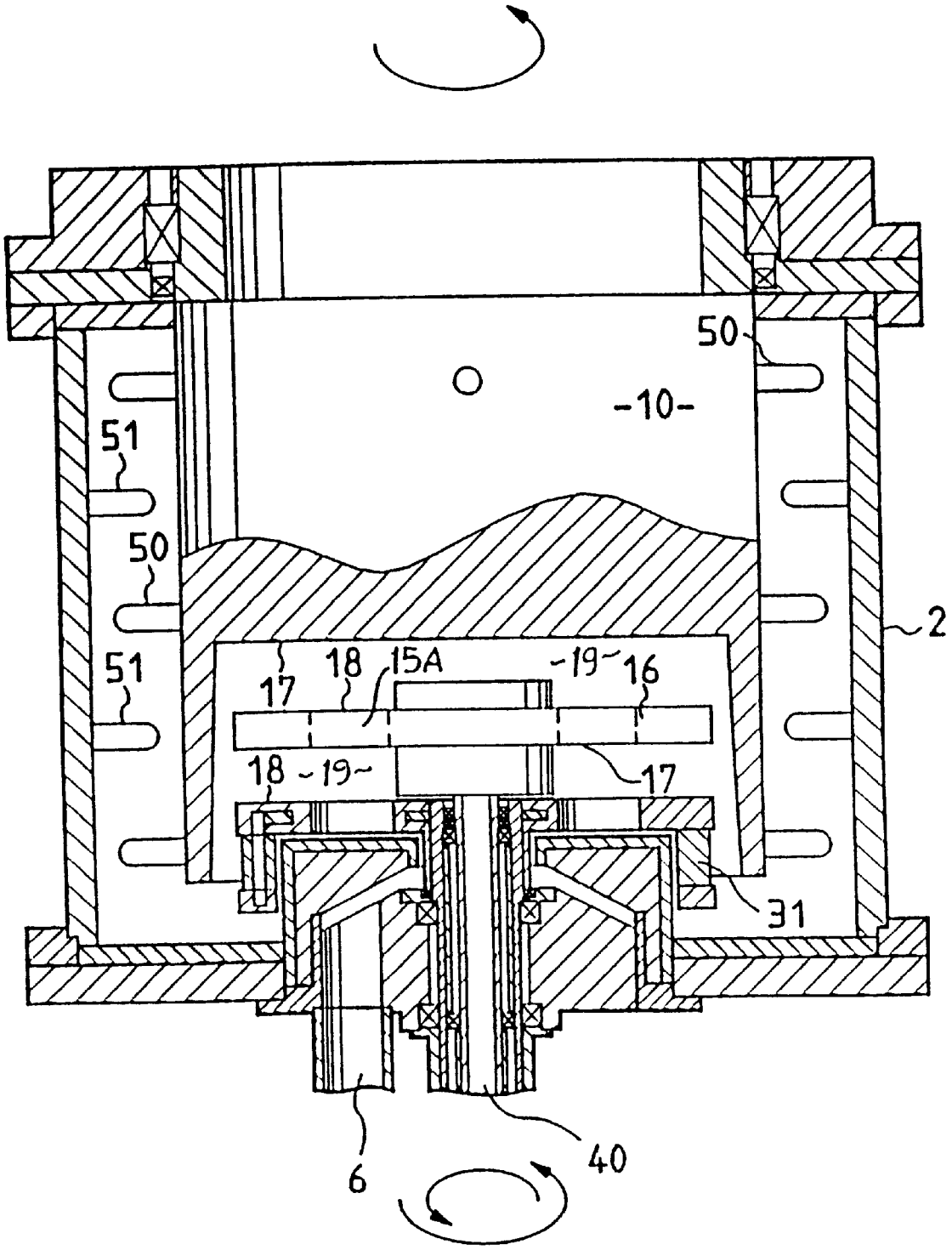

FIG. 25 illustrates a peg mill in which the classification system of the invention is situated in a recess defined within the peg rotor.

As will be apparent to those skilled in the art from the teaching hereof, features of one embodiment may be combined with those of another in various ways in accordance with the teaching hereof.

By way of further example, a mill according to the invention and according to FIG. 6 having an effective capacity of in excess of 1000 liters was operated at power draws of around 900 kilowatts and at volumetric flow rates up to about 110 cubic meters per hour. The mill has a classifier disc in excess of 1000 mm in diameter spaced at 150 mm from a separator rotor 30. Grinding discs 14 were approximately 300 mm apart. The ratio between the outer diameter of separator rotor 30 and the inner diameter of the grinding chamber was from 0.7 to 0.95. The mill was fed with zinc rougher and scavenger concentrate in some tests and with lead rougher concentrate in others. The feed size of the concentrates to be ground varied between 80% passing 45 micron (D80=45 micron) and 80% passing 57 micron. (D80=57 micron). The target product size was 80% passing 16 microns (D80=16 micron).

Three different kinds of grinding media were utilized: (a) "Slag" of relative density 3.75, (b) "Sand" of relative density 2.65 (c) heavy media reject ("HM") of relative density 3.1. The D50 and D80 for both the media as fed and the media content at equilibrium is shown in Table 1.

TABLE 1

| | D50 | D80 |
|---|---|---|
| Feed | | |
| Sand | 2.36 | 3.88 |
| Slag | 1.78 | 2.31 |
| HM | 2.51 | 3.32 |
| Contents | | |
| Sand | 2.44 | 3.10 |
| Slag | 0.71 | 1.05 |
| HM | 1.79 | 2.63 |

The D50 for the sand was finer than for the product due to the presence of fines in the feed. The feed sand contained approximately 30% of particles less than 1 mm in size and which were not retained by the mill. The power and flow rate was varied to achieve the target product size. The media cut was estimated to occur as follows: (a) slag 0.4 mm, (b) sand 1.4 mm, (c) and HM 0.7 mm. That is to say smaller particles exited from the mill while larger particles were retained.

It will be appreciated that these results were obtained without using a separator screen at the mill outlet. A screen was used at the outlet for flow control purposes but having orifices in excess of 20 mm in diameter which would serve no purpose whatsoever for particle size classification in the circumstances described. The mill was operated without shut down due to outlet clogging, shutdown eventually only becoming necessary to replace worn grinding discs.

Apparatus according to the invention is desirably of greater than 10 cubic meters per hour throughput capacity and more preferably greater than 100 cubic meters per hour.

It will be understood that although the invention has been described with reference to grinding elements in the form of "discs" and similar classifier "discs", these elements need not be of circular plan. For example triangular, or square elements, striker bars, hammers and the like could be used instead of discs. If radially disposed strikers are used then axial flow through the plane of rotation occurs between the strikers.

The number and/or location of the apertures in the classifier element may differ from those of the grinder elements and the radial distance of the apertures from the axis may be used to control the classification "cut".

It will also be understood that other forms of separator or secondary classification stage may be employed and these need not include rotary elements.

More than one classifier element may be employed. The classifier element need not be associated with a separator rotor but may be at a distance "c" from an adjacent grinder rotor or from another adjacent classifier element.

For example, the separator stage may simply be a suitably orientated outlet (for example a radial aperture in a hollow drive shaft) with a classifier disc on either side of the aperture.

It will be understood that spacing "g" between grinding elements will not necessarily in fact be the optimum spacing but that a spacing will be purposively chosen with grinding criteria rather than classification criteria in mind. Likewise, spacing "c" between classifier elements and the adjacent separator rotor or grinding disc will be chosen to promote classification rather than size reduction and/or to reduce separator wear.

The invention herein described may be employed in other forms and the features of one embodiment combined with those of another without departing from the scope hereof.

We claim:

1. An attrition mill apparatus comprising:

a grinding chamber (1) having a grinding stage or stages ("GS");

one or more inlets (3) for admitting into the apparatus a coarse grinding medium, a slurrying liquid, and a substance to be ground;

an apparatus outlet (6);

an axial impeller (10) disposed in the grinding chamber (1) and adapted to cooperate with a slurry of the medium to reduce the particle size of the substance to fine particles;

a classifier ("CS") within the grinding chamber for classifying particles in the slurry on the basis of particle mass so that a slurry of fine particles flows to said apparatus outlet and discharges from the mill while coarse particles return to the grinding stage or stages ("GS"); and wherein the fine particles pass from the classifier ("CS") to said outlet (6) via at least one passage selected from the group consisting of at least one screened passage (24) and at least one unscreened passage (25), said at least one passage having a minimum passage dimension which is not only greater than the dimension of fine particles discharged, but also is greater than the D50 dimension of the equilibrium grinding medium retained in the mill.

2. The apparatus according to claim 1, wherein the minimum passage dimension is greater than the D80 dimension of the equilibrium grinding medium retained in the mill.

3. The apparatus according to claim 2, wherein the minimum passage dimension is greater than at least twice the maximum dimension of equilibrium grinding medium retained in the mill.

4. The apparatus according to claim 1, wherein the at least one passage (24 or 25) is screened (24) and the minimum passage dimension is a screen orifice.

5. The apparatus according to claim 1, wherein the grinding stage or stages are adapted to grind a substance to be ground to a fineness of at least 80% passing 16 microns.

6. The apparatus according to claim 1, including at least 2 grinding elements spaced apart by a distance "g" along the axial impeller wherein the classifier comprises a classification element mounted on the rotor and spaced by a distance "c" from an adjacent grinding element, wherein "c" is less than "g".

7. The apparatus according to claim 6, wherein "g" is selected to optimize grinding and wherein "c" is selected so as to classify the fine particles from the mixture of the coarse and the fine particles.

8. The apparatus as claimed in claim 6, wherein "c" is selected to permit the coarse and fine particles to circulate spirally between the periphery of the grinding elements and the impeller shaft.

9. The apparatus as claimed in claim 6, wherein "c" is less than 0.75 times "g".

10. The apparatus as claimed in claim 6, wherein "c" is less than 0.6 times "g" and greater than 0.01 times "g".

11. The apparatus according to claim 6, wherein "c" is less than 0.6 times "g" and greater than 0.4 times "g".

12. The apparatus according to claim 6, wherein the classifier element is a radially directed disk pierced by one or more openings.

13. The apparatus according to claim 12, wherein the classifier element is pierced by equiangularly spaced openings.

14. The apparatus according to claim 12, wherein the classifier element has substantially the same diameter as an adjacent grinding element.

15. The apparatus according to claim 1, including at least two grinding elements spaced apart by a distance "g" along the axial impeller and a first classification element spaced from a second classification element by a distance "c" which is less than "g" and wherein at least one of said classification elements is driven in axial rotation with respect to the other.

16. The apparatus according to claim 15, wherein said classification elements are annular disks pierced by axially extending apertures.

17. The apparatus according to claim 15, wherein each of the first and second classifier elements are driven in rotation independently of each other.

18. The apparatus according to claim 17, wherein one of the elements is driven in counter rotation to the other.

19. The apparatus according to claim 1, containing a grinding medium having a particle size distribution, when fed to the mill, of 80% passing at least 2.3 mm.

20. The apparatus according to claim 1, containing a feed to be ground having a particle size distribution D80 passing from 45 microns to 57 microns.

21. The apparatus according to claim 20, wherein the particle size distribution of the product is such that at least 80% of the product passes 16 micron.

22. The apparatus according to claim 1, further including a separator stage ("SS") defining a separator outlet (25) and a radially disposed passage (33), wherein the classifier has a classifier passage outlet (32), and the particles exiting the classifier via the classifier passage outlet (32) enter the radially disposed passage (33) and exit from the radially disposed passage (33) at the separator outlet (25) which is disposed radially inwardly of the classifier outlet (32).

23. A method for classifying particles in a slurry, comprising a substance to be ground, in an attrition mill having one or more inlets, an apparatus outlet (6), a grinding chamber having a grinding stage or stages ("GS"), an axial impeller (10) disposed in the grinding chamber and adapted to cooperate with a slurry of coarse grinding medium to reduce to fine particles the substance to be ground, comprising the steps of:

admitting the slurry to a passage (19) having a passage inlet (15A) and a passage outlet (32) disposed opposite or radially inwards of the passage inlet (15A), rotating the slurry in the passage about the impeller axis, and selecting the velocity of rotation of the slurry having regard to the mass of coarse and fine particles in the slurry to separate the coarse particles from the fine particles so that slurry exiting from the passage outlet contains the fine particles and is substantially free of coarse particles.

24. The method according to claim 23, wherein the slurry is driven in a rotation by means of a pair of discs spaced apart by a distance less than the spacing between adjacent grinding elements and defining the passage therebetween.

25. The method according to claim 24, containing a grinding medium having a particle size distribution, when fed to the mill, of 80% passing at least 2.3 mm.

26. The method according to claim 24, containing a feed to be ground having a particle size distribution D80 passing from 45 microns to 57 microns.

27. The method according to claim 24, wherein the rotational velocity of the pair of discs in selected so that particles entrained in the slurry exiting from the radially inner passage outlet have a particle size distribution such that at least 80% pass 16 microns.

28. The method according to claim 23, further including a separator stage ("SS") defining a separator outlet (25) and a radially disposed passage (33), wherein the classifier has a classifier passage outlet (32), and the particles exiting the classifier via the classifier passage outlet (32) enter the radially disposed passage (33) and exit from the radially disposed passage (33) at the separator outlet (25) which is disposed radially inwardly of the classifier outlet (32).

29. The method according to claim 23, wherein the slurry exiting from said passage outlet passes through another passage including from said passage outlet to and through the apparatus outlet wherein the minimum dimension of said another passage is not only greater than the dimension of the fine particles discharged from the mill but would pass therethrough 80% of the equilibrium grinding medium content retained in the mill.

30. The method according to claim 29, wherein said another passage comprises a member of he group consisting of a screen having a minimum dimension for which 80% of the equilibrium grinding medium content retained in the mill is capable of passing through the screen and no screen.

31. A method for classifying particles in a slurry, comprising a substance to be ground, in an attrition mill having one or more inlets, an apparatus outlet (6), a grinding chamber having a grinding stage or stages ("GS"), an axial impeller (10) disposed in the grinding chamber and adapted to cooperate with a slurry of coarse grinding medium to reduce to fine particles the substance to be ground, comprising the steps of:

admitting the slurry to a passage (19) having a passage inlet (15A) and a passage outlet (32) disposed opposite or radially inwards of the passage inlet (15A), rotating the slurry in the passage about the impeller axis, and selecting the velocity of rotation of the slurry having regard to the mass of coarse and fine particles in the slurry to separate the coarse particles from the fine particles so that slurry exiting from the passage outlet contains the fine particles and is substantially free of coarse particles, wherein the slurry exiting from said passage outlet passes from said passage outlet to the apparatus outlet via another passage wherein the minimum dimension is not only greater than the dimension of the fine particles discharged from the mill but also would pass therethrough 80% of the equilibrium grinding medium content retained in the mill.

32. A method for classifying particles in a slurry, comprising a substance to be ground, in an attrition mill having one or more inlets, an apparatus outlet (6), a grinding chamber having a grinding stage or stages ("GS"), an axial impeller (10) disposed in the grinding chamber and adapted to cooperate with a slurry of coarse grinding medium to reduce to fine particles the substance to be ground, comprising the steps of:

admitting the slurry to a passage (19) having a passage inlet (15A) and a passage outlet (32) disposed opposite or radially inwards of the passage inlet (15A), rotating the slurry in the passage about the impeller axis, and selecting the velocity of rotation of the slurry having regard to the mass of coarse and fine particles in the slurry to separate the coarse particles from the fine particles so that slurry exiting from the passage outlet contains the fine particles and is substantially free of coarse particles, wherein the slurry is driven in a rotation by means of a pair of discs spaced apart by a distance less than the spacing between adjacent grinding elements and defining the passage therebetween, wherein the impeller includes at least two grinding elements spaced apart by a distance "g" along the axial impeller and the pair of discs is mounted on the rotor and spaced by a distance "c" from an adjacent grinding element, wherein "c" is less than 0.7 times "g".

33. The apparatus according to claim 32, wherein "c" is less than 0.6 times "g" and greater than 0.01 times "g".

34. The method according to claim 32, wherein "c" is less than 0.6 times "g" and greater than 0.4 times "g".

35. A method for classifying particles in a slurry, comprising a substance to be ground, in an attrition mill having one or more inlets, an apparatus outlet (6), a grinding chamber having a grinding stage or stages ("GS"), an axial impeller (10) disposed in the grinding chamber and adapted to cooperate with a slurry of coarse grinding medium to reduce to fine particles the substance to be ground, comprising the steps of:

admitting the slurry to a passage (19) having a passage inlet (15A) and a passage outlet (32) disposed opposite or radially inwards of the passage inlet (15A), rotating the slurry in the passage about the impeller axis, and selecting the velocity of rotation of the slurry having regard to the mass of coarse and fine particles in the slurry to separate the coarse particles from the fine particles so that slurry exiting from the passage outlet contains the fine particles and is substantially free of coarse particles, wherein the slurry is driven in a rotation by means of a pair of discs spaced apart by a distance less than the spacing between adjacent grinding elements and defining the passage therebetween, wherein the coarse particles are separated from the fine particles solely by centrifugal force.

36. An attrition mill comprising:

a grinding chamber having a grinding stage or stages;

one or more inlets for admitting into the apparatus a coarse grinding medium, a slurrying liquid, and a substance to be ground;

an apparatus outlet;

an axial impeller disposed in the grinding chamber and adapted to cooperate with a slurry of said medium to reduce the particle size of said substance; and a classifying stage wherein the particles are separated for discharge from the mill from particles to be returned to the grinding stage or stages solely by centrifugal force.

* * * * *

UNITED STATES PATENT AND TRADEMARK OFFICE

CERTIFICATE OF CORRECTION

PATENT NO. : 5,984,213

DATED : November 16, 1999

INVENTOR(S) : Woodall et al

It is certified that error appears in the above-identified patent and that said Letters Patent are hereby corrected as shown below: Title page, item [73], change "Mount Isa MInes Limited, Queenlands, Australia: Erich Netzsch GmgH & Co. Holding KG, Selb. Germany" to --Mount Isa Mines Limited, Queenlands, Australia: Erich Netzsch GmbH & Co. Holding KG, Selb. Germany--

Signed and Sealed this

Tenth Day of April, 2001

*Attest:*

Nicholas P. Godici

NICHOLAS P. GODICI

*Attesting Officer*

*Acting Director of the United States Patent and Trademark Office*